US007412728B2

(12) United States Patent
Alesina et al.

(10) Patent No.: US 7,412,728 B2
(45) Date of Patent: Aug. 19, 2008

(54) GARMENT WITH A VENTING STRUCTURE AND METHOD OF USING THE SAME

(75) Inventors: Inna Alesina, Owings Mills, MD (US); Nestor M. Benavides, Ellicott City, MD (US); Teresa S. Healy, Baltimore, MD (US); Daniel Kinsbourne, Ellicott City, MD (US); Brian E. Le Gette, Baltimore, MD (US); David L. Reeb, Columbia, MD (US); Christopher Saturnio, Annapolis, MD (US); Alan S. Tipp, Ellicott City, MD (US); Lauretta Welch, Baltimore, MD (US)

(73) Assignee: 180s, Inc., Baltimore, MD (US)

( * ) Notice: Subject to any disclaimer, the term of this patent is extended or adjusted under 35 U.S.C. 154(b) by 124 days.

(21) Appl. No.: 10/927,428

(22) Filed: Aug. 27, 2004

(65) Prior Publication Data

US 2006/0041990 A1 Mar. 2, 2006

(51) Int. Cl.
*A41D 3/02* (2006.01)
*A41D 1/00* (2006.01)

(52) U.S. Cl. ..... 2/93; 2/85; 2/DIG. 1; 2/69

(58) Field of Classification Search ..... 2/93, 2/456, 69, 97, DIG. 1, 77, 85, 87, 115
See application file for complete search history.

(56) References Cited

U.S. PATENT DOCUMENTS

| | | | |
|---|---|---|---|
| 0,308,244 | A | 11/1884 | Fishel |
| 1,261,448 | A | 4/1918 | Siegel |
| 2,114,514 | A | 4/1938 | York |
| D115,983 | S | 8/1939 | Bailey |
| 2,292,348 | A | 8/1942 | Bailey |
| 2,391,535 | A | 12/1945 | Zelano |
| 2,415,996 | A | 2/1947 | Eilenberg |
| 2,543,317 | A | 2/1951 | Hammond |
| 2,661,474 | A | 12/1953 | Tate |
| 2,713,168 | A | 7/1955 | Bagnato |
| 2,715,226 | A | 8/1955 | Weiner |
| 3,045,243 | A | 7/1962 | Lash et al. |
| 3,153,793 | A | 10/1964 | Lepore |
| 3,691,564 | A | 9/1972 | La Marre et al. |
| 3,761,962 | A | 10/1973 | Myers |
| 3,969,772 | A | 7/1976 | Pravaz |
| 4,185,327 | A | 1/1980 | Markve |
| 4,513,451 | A | 4/1985 | Brown |
| 4,608,715 | A | 9/1986 | Miller et al. |
| 4,619,004 | A | 10/1986 | Won |
| 4,722,099 | A | 2/1988 | Kratz |
| 4,731,883 | A | 3/1988 | Foster |
| 4,783,858 | A | 11/1988 | Chevalier |

(Continued)

FOREIGN PATENT DOCUMENTS

| | | |
|---|---|---|
| DE | 667304 | 11/1938 |

(Continued)

*Primary Examiner*—Katherine Moran
*Assistant Examiner*—Richale L Quinn
(74) *Attorney, Agent, or Firm*—Edell, Shapiro & Finnan LLC

(57) ABSTRACT

This invention relates generally to apparel, and in particular, to a garment with a venting structure and a method of using the venting structure.

23 Claims, 29 Drawing Sheets

U.S. PATENT DOCUMENTS

| | | | | |
|---|---|---|---|---|
| 5,101,514 | A | 4/1992 | Eklund | |
| 5,105,477 | A | 4/1992 | Golde | |
| 5,105,478 | A | 4/1992 | Pyc | |
| 5,507,042 | A | 4/1996 | van der Slessen | |
| 5,642,526 | A | 7/1997 | Thompson | |
| 5,704,064 | A | 1/1998 | van der Sleesen | |
| 5,727,256 | A | 3/1998 | Rudman | |
| 5,752,277 | A | 5/1998 | van der Sleesen | |
| 5,845,336 | A | 12/1998 | Golde | |
| 5,946,724 | A * | 9/1999 | Erickson | 2/93 |
| 6,070,274 | A | 6/2000 | van der Sleesen | |
| 6,085,353 | A | 7/2000 | van der Sleesen | |
| 6,163,883 | A | 12/2000 | Hong | |
| 6,263,510 | B1 | 7/2001 | Bay et al. | |
| 6,339,843 | B1 | 1/2002 | Grilliot et al. | |
| 6,339,845 | B1 | 1/2002 | Burns et al. | |
| 6,668,385 | B2 | 12/2003 | Gathings, Jr. | |
| 6,795,976 | B1 | 9/2004 | van der Sleesen | |
| 6,868,557 | B1 | 3/2005 | van der Sleesen | |
| 6,883,178 | B2 | 4/2005 | van der Sleesen | |
| 6,907,619 | B2 | 6/2005 | Gathings, Jr. | |
| 2003/0033656 | A1 | 2/2003 | Jaeger | |
| 2003/0140404 | A1 | 7/2003 | Golde | |
| 2003/0177616 | A1 | 9/2003 | Petravic et al. | |
| 2004/0055069 | A1 | 3/2004 | Fayle et al. | |
| 2004/0133962 | A1 | 7/2004 | Baumel | |
| 2004/0158910 | A1 | 8/2004 | Bay | |
| 2004/0237168 | A1 * | 12/2004 | Braun | 2/93 |

FOREIGN PATENT DOCUMENTS

| | | |
|---|---|---|
| DE | 872331 | 3/1953 |
| FR | 2634984 | 2/1990 |
| FR | 2643793 | 9/1990 |
| GB | 16900 | 10/1911 |
| GB | 111325 | 11/1917 |
| GB | 157529 | 1/1921 |
| GB | 570150 | 6/1945 |
| WO | 9624263 | 8/1996 |
| WO | 9942010 | 8/1999 |

* cited by examiner

FIG. 33
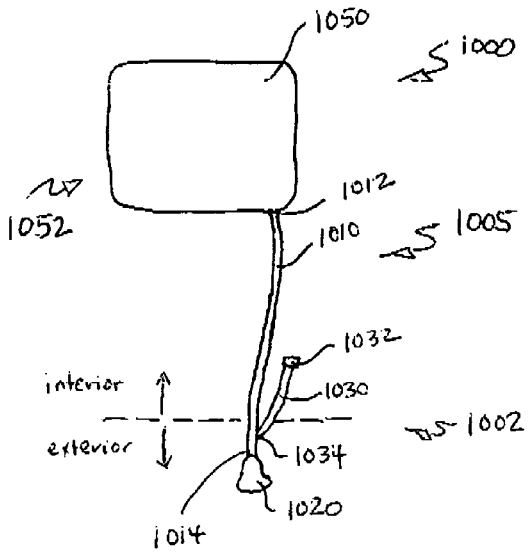
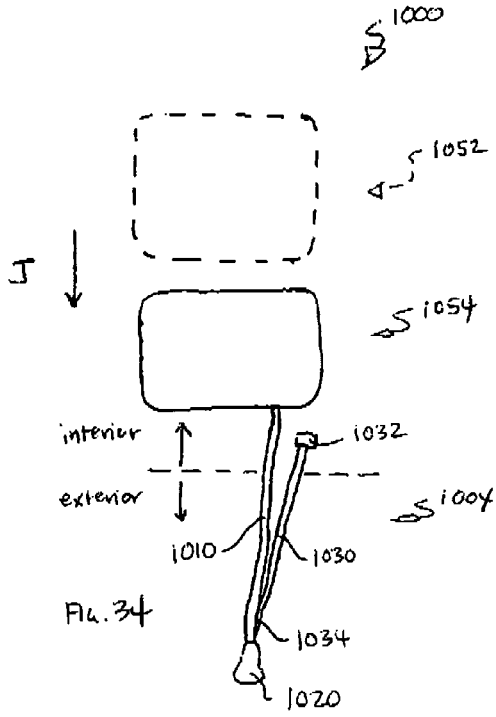
FIG. 34
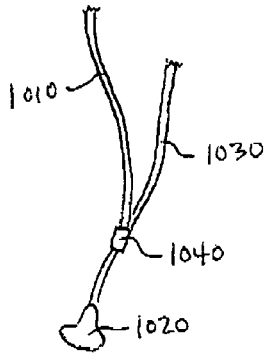
FIG. 35

GARMENT WITH A VENTING STRUCTURE AND METHOD OF USING THE SAME

BACKGROUND OF THE INVENTION

This invention relates generally to apparel, and in particular, to a garment with a venting structure and a method of using the venting structure.

Typically, people wear garments to provide protection from the elements. Depending on the environmental conditions, people wear different garments to keep warm, even during the start of exercise. As the user's body heats up during an activity, at some point the user will become uncomfortable in the garment and will need to cool down.

Typically, the user will wear several layers of garments and will remove a layer when necessary to cool down. Such removal can be difficult during the exercise, particularly, depending on the exercise. Moreover, the user usually has to carry or otherwise dispose of the removed garment. Alternatively, some known garments include an opening through which air can flow into and/or out of the garment.

Thus, a need exists for a garment that includes a venting structure that can be easily adjusted to control the flow of air into and/or out of the garment.

SUMMARY OF THE INVENTION

A garment comprises a shell that has a vent structure that includes an opening in the shell. The opening is configured to allow the flow of air into and out of the shell. In one embodiment, the garment includes a controlling or blocking mechanism that can be moved relative to the opening to control the flow of air through the opening. In one embodiment, the controlling mechanism includes a panel or layer of material that can be moved relative to the shell.

The controlling mechanism can also include a movement mechanism that is coupled to the panel and can be manipulated to move the panel relative to the shell. In one embodiment, the controlling mechanism includes a movement mechanism to move the panel in a first direction and another movement mechanism to move the panel in a second direction. In one embodiment, the panel is selectively disposable in several positions, including a position in which the opening is blocked and a position in which a portion of the opening is not blocked by the panel.

BRIEF DESCRIPTION OF THE DRAWINGS

FIG. 33 is a schematic diagram of an embodiment of a controlling mechanism in a first configuration.

FIG. 34 is a schematic diagram of the controlling mechanism illustrated in FIG. 33 in a second configuration.

FIG. 35 is a partial view of some components of the controlling mechanism illustrated in FIG. 33.

DETAILED DESCRIPTION

A garment comprises a shell that has a vent structure that includes an opening in the shell. The opening is configured to allow the flow of air into and out of the shell. In one embodiment, the garment includes a controlling or blocking mechanism that can be moved relative to the opening to control the flow of air through the opening. In one embodiment, the controlling mechanism includes a panel or layer of material that can be moved relative to the shell.

The controlling mechanism can also include a movement mechanism that is coupled to the panel and can be manipulated to move the panel relative to the shell. In one embodiment, the controlling mechanism includes a movement mechanism to move the panel in a first direction and another movement mechanism to move the panel in a second direction. In one embodiment, the panel is selectively disposable in several positions, including a position in which the opening is blocked and a position in which a portion of the opening is not blocked by the panel.

The term "vent structure" is intended to encompass any type of opening through which air can flow. The terms "vent structure," "vent opening" and "air flow opening" are used interchangeably herein. Some of the openings or vent structures described herein include an air permeable layer of material that is substantially co-extensive with the opening. One example of an air permeable material is mesh. Another example of an air permeable material is a material that has fewer, larger holes than mesh. Both exemplary materials can be referred to alternatively as porous materials.

The terms "movable panel," "movable layer," "panel" and "layer" are sometimes used interchangeably and are intended to encompass any type of material that can be disposed proximate to an opening and moved relative to the opening. A panel may include one or more layers of material. The terms "controlling mechanism" and "blocking mechanism" are used interchangeably herein.

Figure 1:
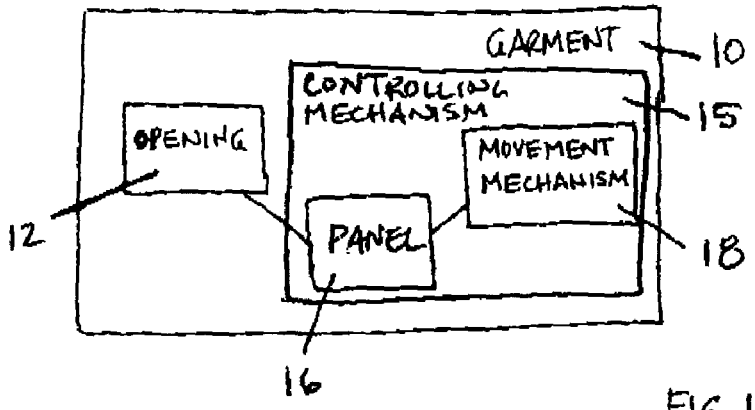
FIG. 1 is a block diagram of an embodiment of a garment according to the invention.

A block diagram of a garment according to an embodiment of the invention is illustrated in FIG. 1. The garment 10 includes a vent structure or opening 12. In one embodiment, the opening 12 can be located in the rear portion of the garment 10. In alternative embodiments, the opening 12 can be disposed at any location on the garment 10. The size and configuration of the opening 12 can vary among different embodiments.

As illustrated in FIG. 1, the garment 10 includes a controlling or blocking mechanism 15. The amount of air that flows through the opening 12 of the garment 10 can be adjusted by the user via the controlling mechanism 15. A portion of the controlling mechanism 15 is disposed next to the opening 12 to adjust the amount of air flow.

In one embodiment, the controlling mechanism 15 includes a panel or layer 16 that is movable relative to the opening 12. The user can selectively dispose the panel 16 relative to the opening 12 to control how much of the opening 12 is not blocked by the panel 16. For example, the panel 16 can be disposed in several positions relative to the opening 12 to block all, none or a portion of the opening 12.

In this embodiment, the controlling mechanism 15 includes a movement mechanism 18. The movement mechanism 18 is coupled to the panel 16 and can be manipulated to move the panel 16 relative to the opening 12. For example, the user can manipulate the movement mechanism 18 to move the panel 16 so that the panel 16 covers or blocks the opening 12 and reduces the amount of air entering or exiting the garment 10 through the opening 12. Similarly, the panel 16 can be moved so that it does not block a portion of the opening 12, thereby allowing air to flow through the unblocked portion of the opening 12.

Depending on the location of the opening 12, air will flow into or out of the garment 10 through the opening 12. For example, if the garment 10 is a jacket, an opening on the front surface of the jacket will allow air to flow into the jacket to cool the user. Similarly, if an opening is disposed on the rear surface of the jacket, for example, warm air that is inside the jacket will flow out of the opening to cool the user.

The panel 16 can have any size or construction and can be made of any material that blocks at least some of the environmental elements that would otherwise enter the garment 10 through the opening 12. For example, the panel can be one or more layers of fabric membranes coupled together. Alternatively, the panel can be a semi-rigid material, such as a flexible piece of plastic.

Figure 2:
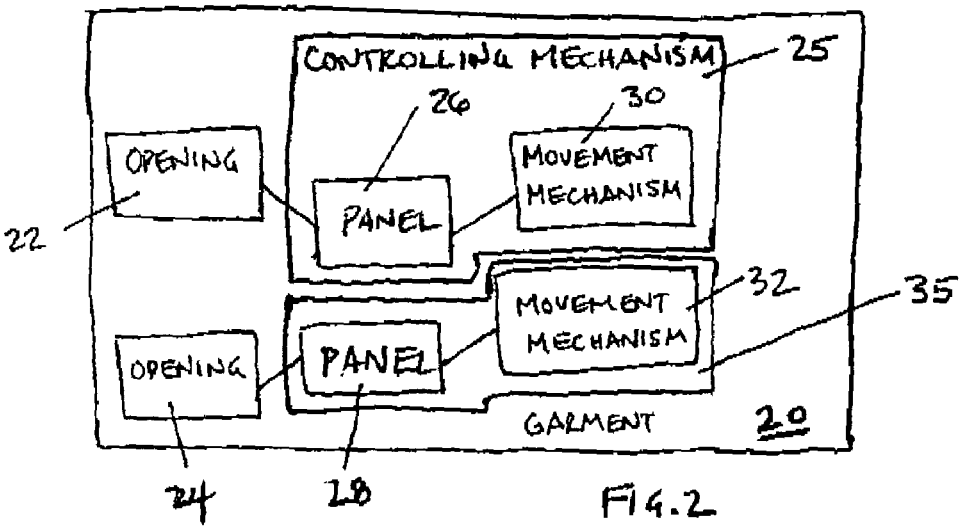
FIG. 2 is a block diagram of an alternative embodiment of a garment according to the invention.

A block diagram of an alternative embodiment of a garment is illustrated in FIG. 2. In this embodiment, the garment 20 includes openings 22 and 24. Openings 22 and 24 allow air to flow into and out of the garment 20. Openings 22 and 24 can have different sizes and constructions and are typically disposed at different locations on the garment 20. For example, opening 22 can be located on the front portion of the garment 20 and opening 24 can be located on the rear portion of the garment 20.

As illustrated in FIG. 2, the garment 20 includes a controlling mechanism 25 associated with opening 22 and a controlling mechanism 35 that is associated with opening 24. The amount of air that flows through the openings 22 and 24 can be controlled by the user via the appropriate controlling mechanism 25 or 35.

In one embodiment, the controlling mechanism 25 includes a panel or layer 26 that is movable relative to opening 22. The user can selectively dispose the panel 26 relative to the opening 22 to control how much of the opening 22 is not blocked by the panel 26. For example, the panel 26 can be disposed in several positions relative to the opening 22 to block all, none or a portion of the opening 22. Similarly, the controlling mechanism 35 includes a panel 28 that is movable relative to opening 24.

In this embodiment, controlling mechanism 25 includes a movement mechanism 30 that is coupled to panel 26. Movement mechanism 30 can be manipulated to move the panel 26 to block none or some portion of the opening 22. Similarly, controlling mechanism 35 includes a movement mechanism 32 that is coupled to panel 28 and can be manipulated to block all, none or some portion of the opening 24. Movement mechanisms 30 and 32 can be operated simultaneously or at different times.

In one implementation, the garment 20 is a jacket with opening 22 in the front portion of the jacket and opening 24 in the rear portion of the jacket. If the user wants air to flow into the front opening 22, then the user can manipulate movement mechanism 30 to move panel 26 so that it does not block the entire opening 22. If the user wants warm air in the garment 20 to flow out through rear opening 24, the user can manipulate movement mechanism 32 to move panel 28 so it does not block the entire opening 24.

Figure 3:
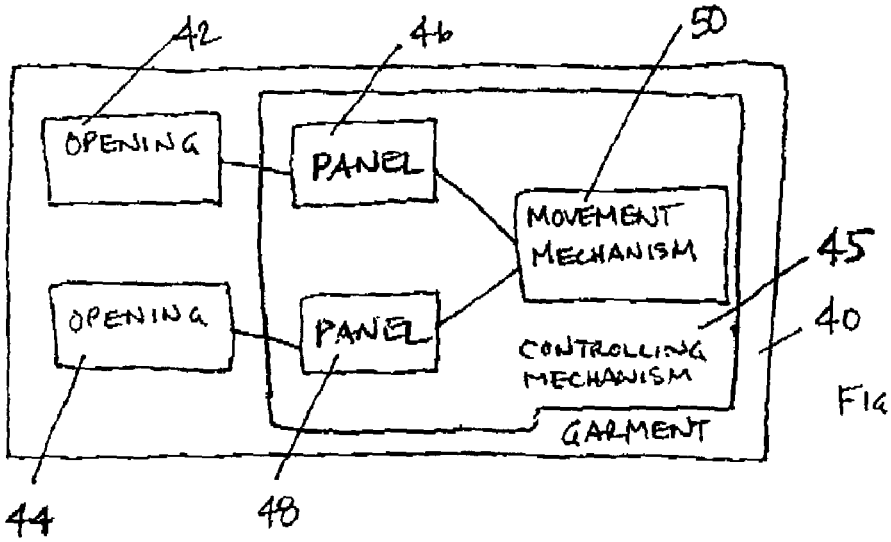
FIG. 3 is a block diagram of an alternative embodiment of a garment according to the invention.
Figure 4:
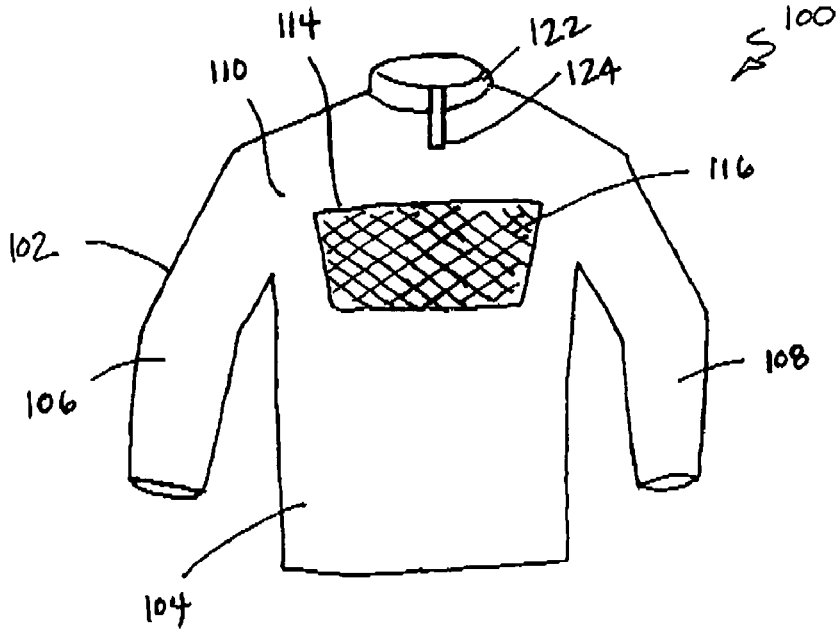
FIG. 4 is a front view of an embodiment of a garment according to the invention.

A block diagram of an alternative embodiment of a garment is illustrated in FIG. 3. In this embodiment, the garment 40 includes vent structures or openings 42 and 44 at different locations. Openings 42 and 44 are configured to allow air to flow into or out of the garment 40.

The garment 40 includes a controlling mechanism 45. The amount of air that flows through openings 42 and 44 can be controlled by the user via controlling mechanism 45. In this embodiment, the controlling mechanism 45 includes panels or layers 46 and 48, which are associated with openings 42 and 44, respectively. The panels 46 and 48 can be moved relative to the openings 42 and 44, respectively, to control how much of the openings 42 and 44 are not blocked. For example, the panels 46 and 48 can be disposed in several positions relative to the openings 42 and 44 to block all, none or a portion of the openings 42 and 44.

In this embodiment, the controlling mechanism 45 includes a movement mechanism 50 that is coupled to panels 46 and 48. In this embodiment, manipulation of the movement mechanism 50 causes panels 46 and 48 to move simultaneously with respect to openings 42 and 44.

An embodiment of a garment is illustrated in FIGS. 4-9. In this embodiment, the garment 100 includes a shell 102 that has a torso portion 104 and sleeve portions 106 and 108. The shell 102 has a front portion 110 and a rear portion 112 (see FIG. 5).

The front portion 110 includes a vent structure or opening 114 that has a material 116, such as mesh, that covers the opening 114 and that has a different air permeability characteristic than the other portion of the shell 102. The air permeable material 116 includes several openings or holes that allow air to flow through the opening 114 into the shell 102. Similarly, the rear portion 112 includes a vent structure or opening 118 that has an air permeable material 120 similar to material 116 that covers the opening 118. The material 120 includes several openings or holes that allow air to flow through the opening 118 into the shell 102.

The garment 100 includes a collar 122 and a closure mechanism 124 associated with the collar 122 to allow a user to put on the garment 100. In one embodiment, the closure mechanism 124 is a zipper.

Figure 6:
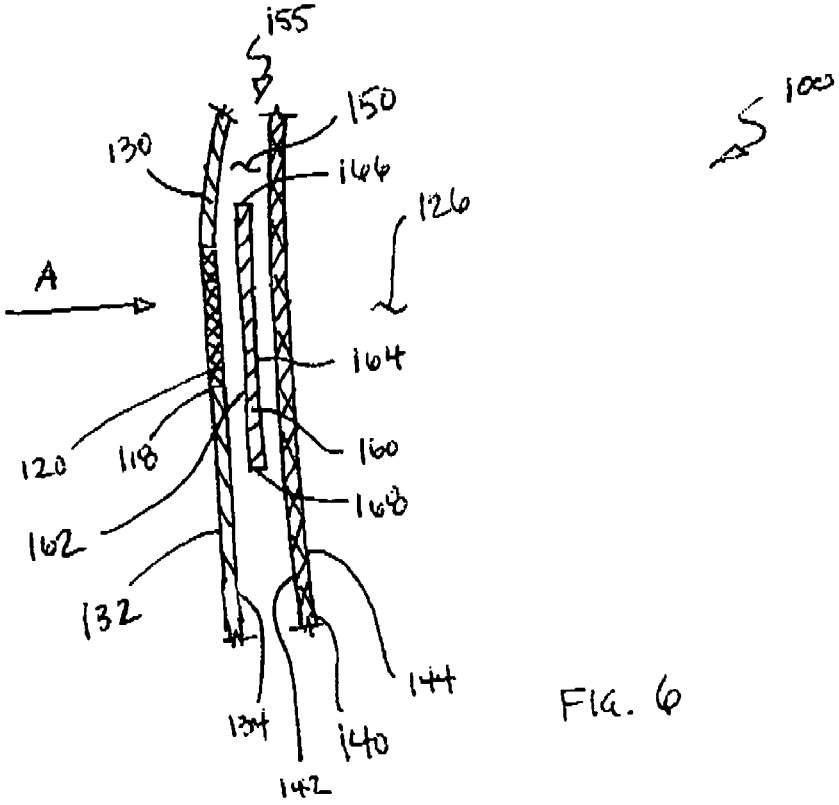
FIG. 6 is a cross-sectional side view of some components of the garment illustrated in FIG. 5 taken along the line "6-6."
Figure 5:
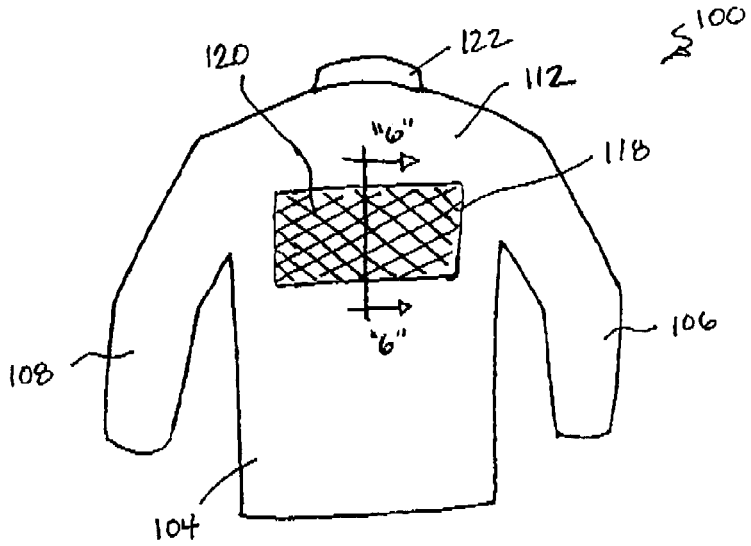
FIG. 5 is a back view of the garment illustrated in FIG. 4.

Referring to FIG. 6, a partial cross-sectional view of some of the components of the garment 100 shown in FIG. 5 is illustrated. In this embodiment, the garment 100 includes an outer layer 130 that has an outer surface 132 and an inner surface 134, and an inner layer 140 that has an outer surface 142 and an inner surface 144. The inner surface 144 of the inner layer 140 defines an interior region 126 of the garment 100 in which the user's body is located. The outer layer 130 includes the previously-identified opening 118. In this embodiment, the inner layer 140 is made of an air permeable material, such as a mesh material.

The inner surface 134 of the outer layer 130 and the outer surface 142 of the inner layer 140 define therebetween a chamber or zone 150. In this embodiment, the garment 100 includes a controlling mechanism 155 that is disposable proximate to the opening 118. The controlling mechanism 155 includes a panel 160 that is disposed in the chamber 150 between the outer layer 130 and the inner layer 140. The panel 160 includes an outer surface 162, inner surface 164, upper end 166 and lower end 168. The panel 160 is selectively disposable relative to opening 118 so that all, a portion or none of the opening 118 is blocked by the layer 160. The air flow from the environment through the opening 118 and into the garment 100 is represented by the arrow A in FIG. 6.

Figure 7:
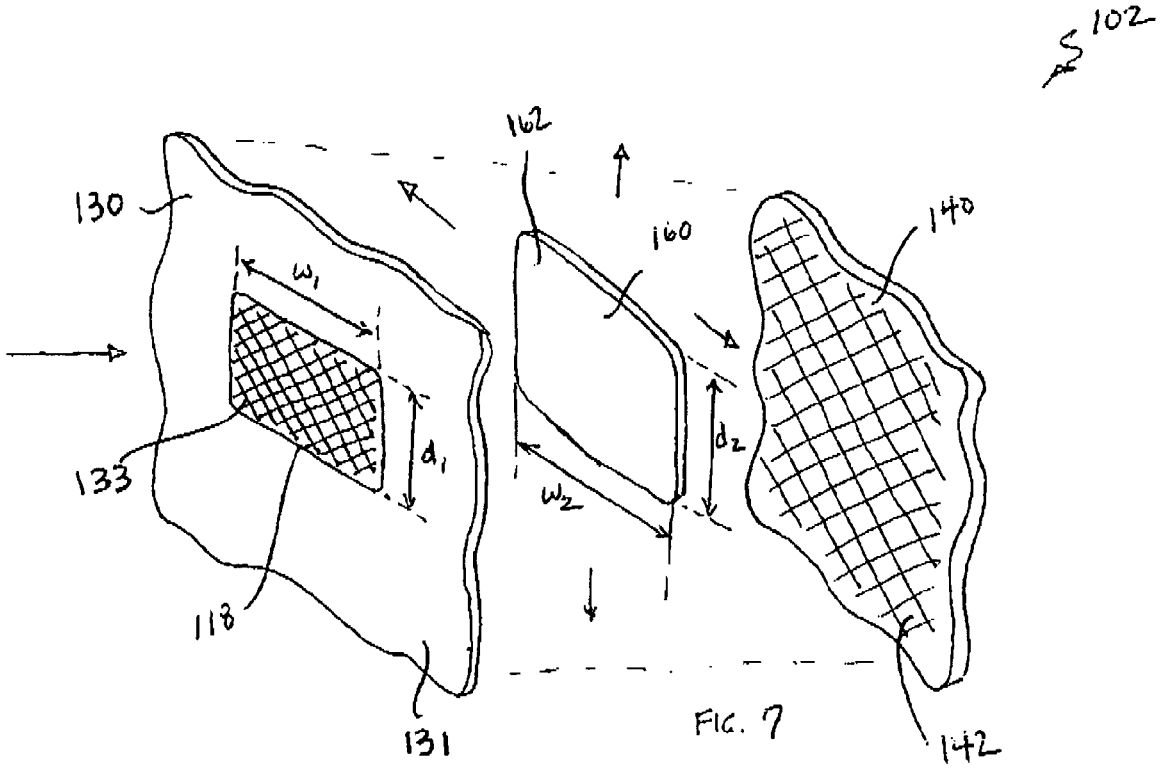
FIG. 7 is an exploded perspective view of portions of some components of the garment illustrated in FIG. 4.

Referring to FIG. 7, an exploded perspective view of some components of the garment 100 is illustrated. As shown, the inner layer 140 is made entirely of an air permeable or porous material. The opening 118 can have any shape and in this embodiment, include dimensions $d_1$ and $w_1$. The panel 160 has dimensions $d_2$ and $w_2$, which in this embodiment are slightly larger than the corresponding dimensions of the opening 118 so that the panel 160 can be positioned to cover the entire opening 118.

In this embodiment, the outer layer 130 includes a first region 131 constructed of a material with a relatively low air permeability (such as a substantially non-porous material) and includes a second region 133 associated with opening 118 that has a material disposed therein with a higher air permeability material than the material of the first region 131.

In alternative embodiments, the layer 160 can be moved in any direction relative to the opening 118 to vary the amount of the opening 118 that is blocked by the panel 160. For example, the panel 160 can be moved upwardly and downwardly. Alternatively, the panel 160 can be moved side to side. Moreover, the panel 160 can be moved diagonally relative to the opening 118.

Figure 8:
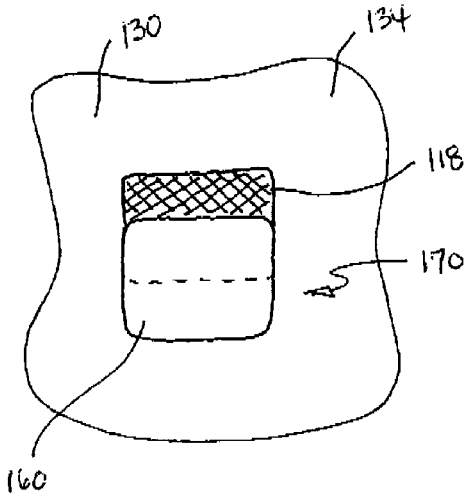
FIG. 8 is an internal view of some components of the garment of FIG. 5 in a first configuration.
Figure 9:
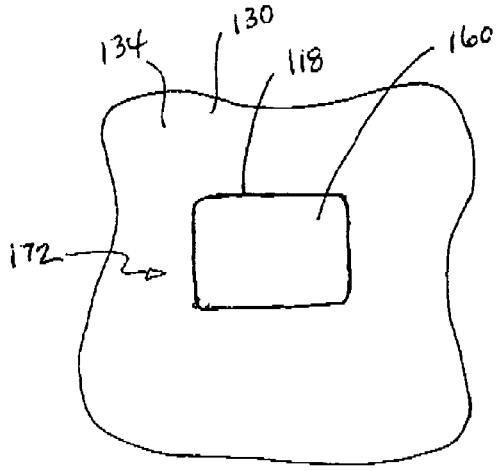
FIG. 9 is an internal view of some components of the garment of FIG. 5 in a second configuration.

Referring to FIGS. 8 and 9, the panel 160 is illustrated in two configurations or positions with respect to opening 118 of the outer layer 130. The panel 160 can be disposed in a first configuration 170 in which a portion of the opening 118 is not blocked (see FIG. 8). In this configuration, the panel 160 is substantially offset or unaligned with the opening 118. The panel 160 can be disposed in a second configuration 172 in which the panel 160 is substantially aligned with the opening 118, thereby blocking the opening 118 and reducing the air flow therethrough.

Figure 10:
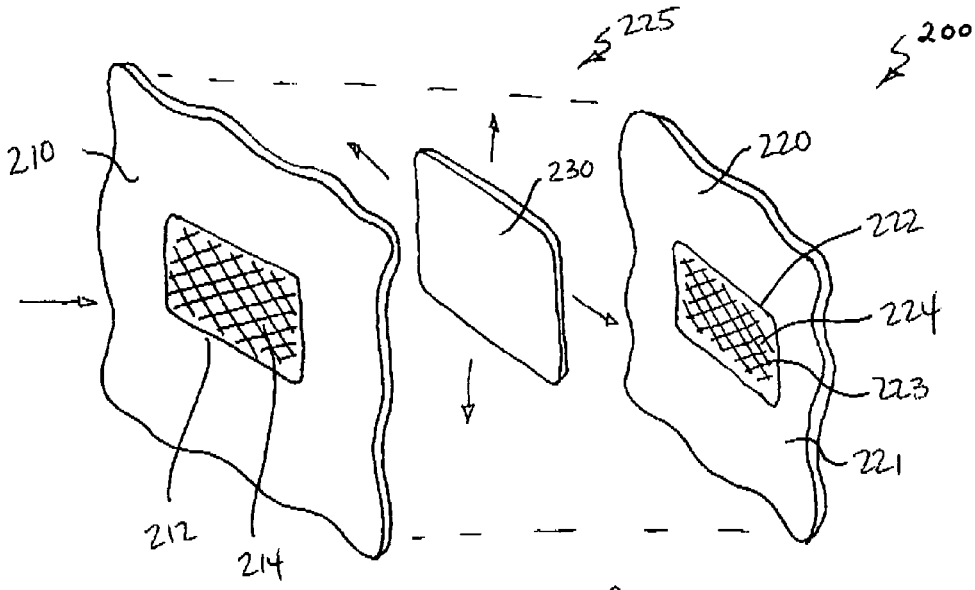
FIG. 10 is an exploded perspective view of some components of an alternative embodiment of a garment according to the invention.

An alternative embodiment of a garment is illustrated in FIG. 10. In this exploded perspective view, only some of the components of the garment are illustrated. The shell 200 includes an outer layer 210 and inner layer 220. The outer layer 210 includes an opening 212 with a porous material 214 disposed therein.

In this embodiment, the inner layer 220 includes a first region 221 constructed of a material with a relatively low air permeability (such as a substantially non-porous material) and includes a second region 223 associated with an opening 222 that has a material 224 disposed therein with a higher air permeability material than the material of the first region 221. The opening 222 in the inner layer 220 and the opening 212 in the outer layer 210 are substantially aligned so that air can flow through the openings 212 and 222.

The garment 200 includes a controlling mechanism 225 that has a panel 230 (see FIG. 10). The panel 230 is disposed between the outer layer 210 and the inner layer 220. Panel 230 is configured so that all, a portion or none of the air that flows through openings 212 and 222 can be blocked. The panel 230 can be moved by a movement mechanism or actuator (not shown) that is coupled to the panel 230.

Figure 11:
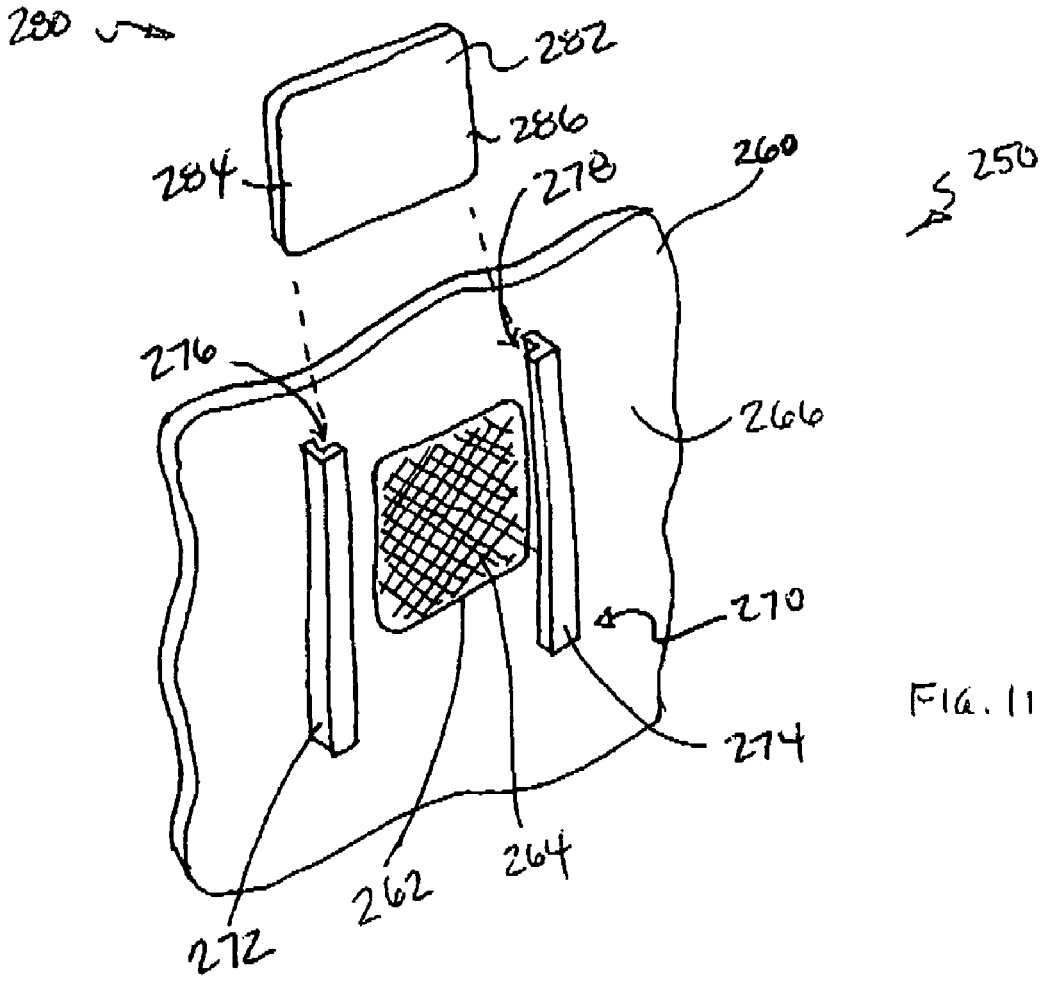
FIG. 11 is an exploded perspective view of some components of an alternative embodiment of a garment according to the invention.

An alternative embodiment of a garment is illustrated in FIG. 11. In this exploded perspective view, only some of the components of the garment are illustrated. The garment 250 includes an outer layer 260 but no inner layer. The outer layer 260 includes an inner surface 266 and an opening 262 with an air permeable material 264, such as mesh.

In this embodiment, the garment 250 includes a guide structure 270. The guide structure 270 includes a pair of guides 272 and 274 that define channels 276 and 278, respectively. The guides 272 and 274 are disposed on opposite sides of the opening 262. The guides can be made of any material that has sufficient rigidity to guide the panel along the opening.

The garment 250 includes a controlling mechanism 280 that has a panel 282 with side portions 284 and 286. The guides 272 and 274 are spaced apart so that the side portions 284 and 286 of the panel 282 can slide into channels 276 and 278, respectively. The guide structure 270 maintains the panel 282 proximate to the outer layer 260 and in particular, the opening 262. The controlling mechanism 280 may include an actuator (not shown) that can be used to move the panel 282.

An alternative embodiment of a garment is illustrated in FIGS. 12-15. In this embodiment, the garment 300 includes a shell 302 that has a torso region 304 and sleeves 306 and 308. The shell 302 includes a front portion 310 and a rear portion 312 (see FIG. 13). The rear portion 312 of the garment 300 includes an opening 314 that has an air permeable material, such as mesh, disposed therein. The opening 314 is in communication with the interior region of the shell 302.

Figure 13:
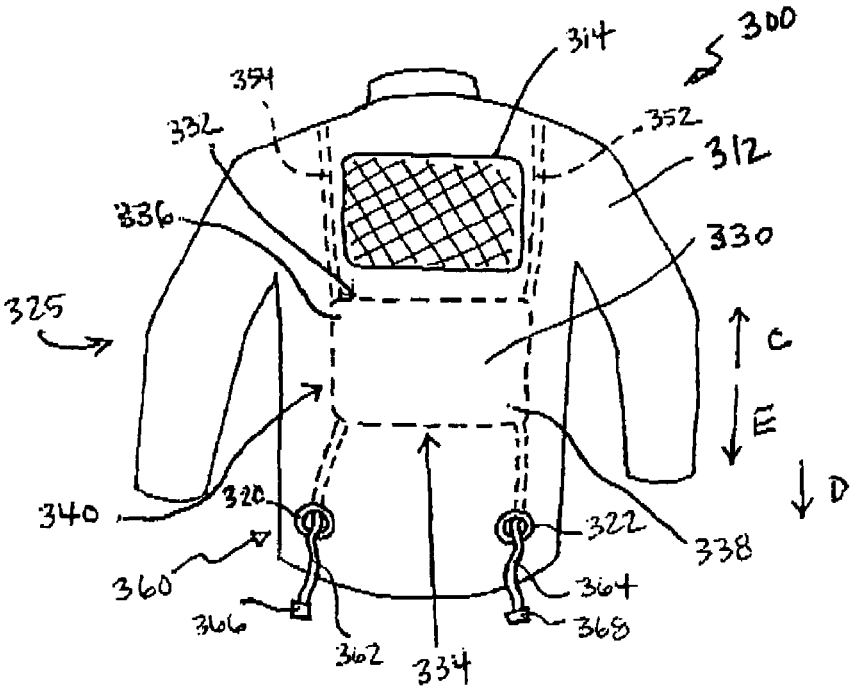
FIG. 13 is a rear view of the garment illustrated in FIG. 12 in a first configuration.
Figure 14:
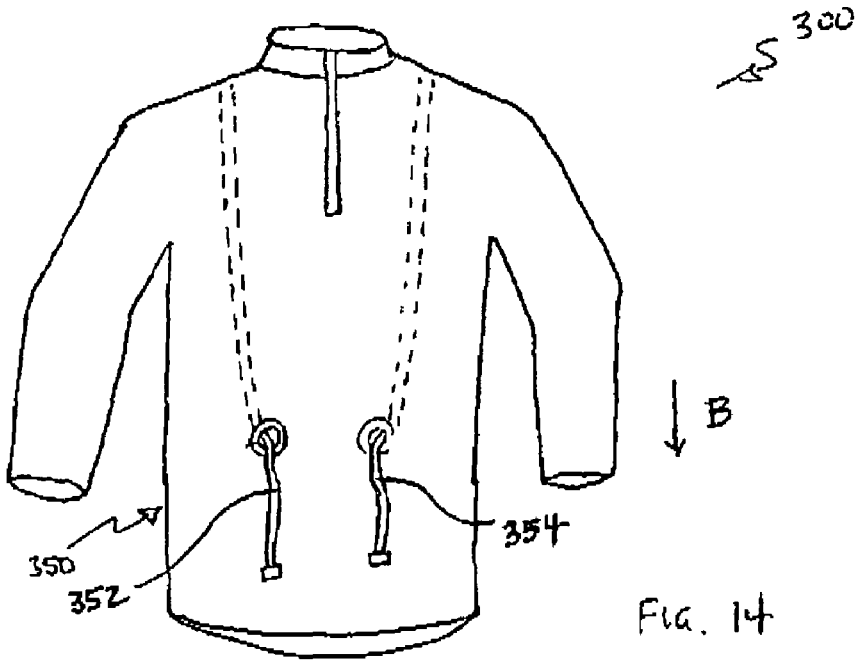
FIG. 14 is a front view of the garment illustrated in FIG. 12 in a second configuration.

As illustrated in FIG. 13, the garment 300 includes a controlling mechanism 325 that can be manipulated to control the air flow through the opening 314. The controlling mechanism 325 includes a panel or layer 330 (shown in phantom) that can be disposed in multiple positions or configurations with respect to the opening 314. The panel 330 is disposed inside of the outer layer of the garment 300 and includes an upper end 332, a lower end 334, upper corners 336 and lower corners 338.

The controlling mechanism 325 includes several movement mechanisms 350 and 360 that are coupled to the panel 330. Movement mechanism 350 is coupled to the upper end 332 of the panel 330, and movement mechanism 360 is coupled to the lower end 334 of the panel 330.

Figure 12:
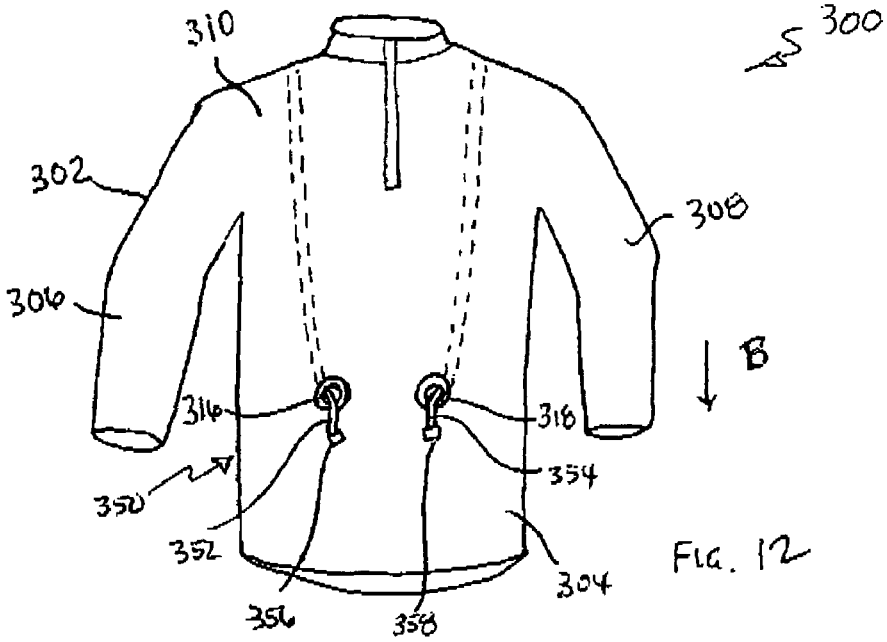
FIG. 12 is a front view of an alternative embodiment of a garment according to the invention.
Figure 15:
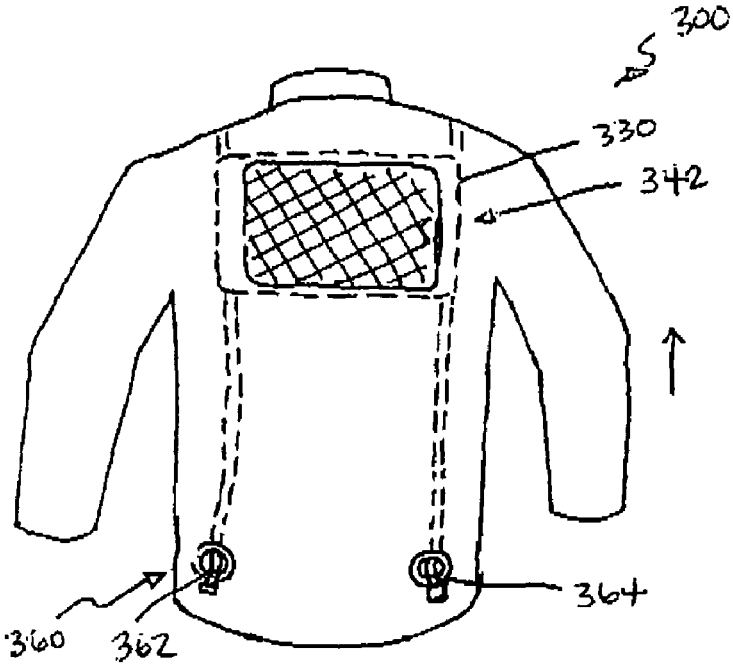
FIG. 15 is a rear view of the garment illustrated in FIG. 14.

When the movement mechanism 350 is moved along the direction of arrow "B" in FIG. 12, the panel 330 is moved from a first configuration 340 (see FIG. 13) along the direction of arrow "C" to a second configuration 342 (see FIG. 15). In configuration 340, the panel 330 does not block the opening 314 and air can easily flow therethrough. In configuration 342, the panel 330 is aligned with opening 314 and the air flow into the interior region of the garment 300 is reduced. When the movement mechanism 350 is moved along the direction of arrow "D" in FIG. 13, the panel 330 is moved from the second configuration 342 along the direction of arrow "E" to the first configuration 340.

In this embodiment, movement mechanism 350 includes actuators 352 and 354. Actuators 352 and 354 can be any type of elongate member, such as a pull cord, string, rope, tape, ribbon, etc. Actuators 352 and 354 include pulls 356 and 358, respectively, coupled to their distal ends (see FIG. 12). The pulls 356 and 358 facilitate the grasping and manipulation of the actuators 352 and 354 by the user. The other ends of the actuators 352 and 354 are coupled to the panel 330.

Similarly, movement mechanism 360 includes actuators 362 and 364. Actuators 362 and 364 can be any type of elongate member, similar to actuators 352 and 354. Actuators 362 and 364 include pulls 366 and 368, respectively, coupled to their distal ends, which facilitate the grasping of the actuators 362 and 364 by the user.

As illustrated in FIG. 12, the shell 302 includes holes or openings 316 and 318 in the front portion 310. Each opening can include a plastic eyelet or grommet associated therewith. Actuator 352 is inserted through the opening 316 and pull 356 is configured to prevent the actuator 352 from disengaging from the opening 316. Similarly, actuator 354 is inserted through the opening 318 and pull 358 is configured to prevent the actuator 354 from disengaging from the opening 318.

Similarly, the shell 302 includes holes or openings 320 and 322 in the rear portion 312 (see FIG. 13). Each opening can include a plastic eyelet or grommet associated therewith. Actuator 362 is inserted through the opening 320 and pull 366 is configured to prevent the actuator 362 from disengaging from the opening 320. Actuator 364 is inserted through the opening 322 and pull 368 is configured to prevent the actuator 364 from disengaging from the opening 322. The actuators 352 and 362 pass through the corresponding holes in the shell 302 and extend from the interior region of the shell 302 to outside of the shell 302.

Figure 16:
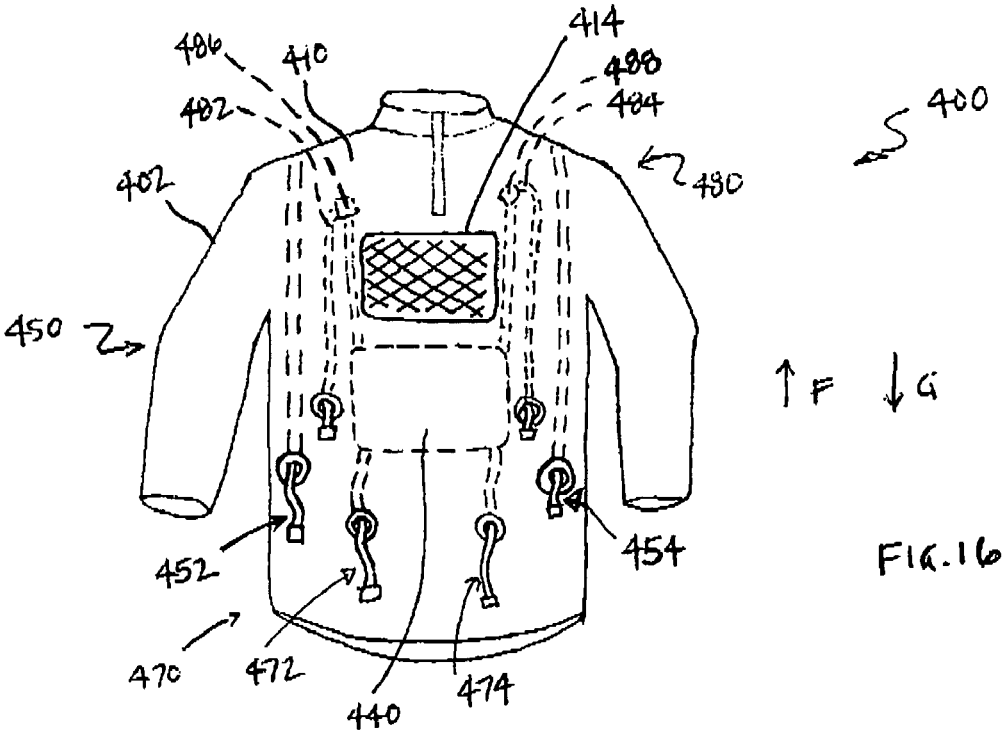
FIG. 16 is a front view of an alternative embodiment of a garment according to the invention.
Figure 17:
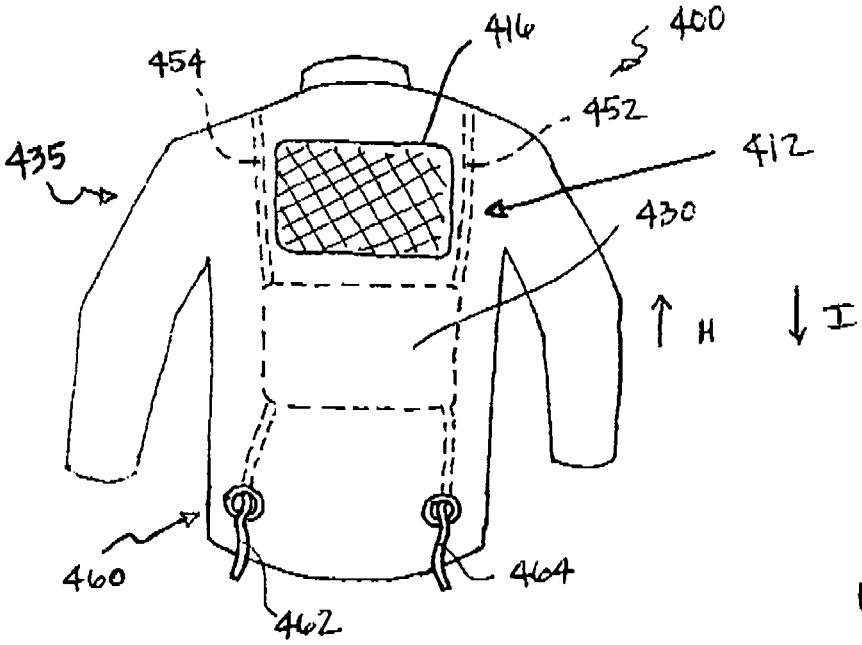
FIG. 17 is a rear view of the garment illustrated in FIG. 16.

An alternative embodiment of a garment is illustrated in FIGS. 16 and 17. In this embodiment, the garment 400 includes a shell 402 that includes a front portion 410 and a rear portion 412 (see FIG. 17). The front portion 410 of the garment 400 includes a vent structure or opening 414 that has an air permeable material, such as mesh, disposed therein. Similarly, the rear portion 412 of the garment 400 includes a vent structure or opening 416 with an air permeable material, such as mesh.

As illustrated in FIG. 16, the garment 400 includes a front controlling mechanism that is associated with opening 414 and a rear controlling mechanism that is associated with opening 412. The front controlling mechanism includes a front panel 440 and movement mechanisms 450 and 460. Similarly, the rear controlling mechanism includes a rear panel 430 and movement mechanisms 470 and 480. The panels 430 and 440 are disposed within the shell 402 and can be disposed in multiple configurations relative to the respective openings.

Movement mechanisms 450 and 460 are coupled to panel 430 to move the panel 430 in two directions opposite to each other. Similarly, movement mechanisms 470 and 480 are coupled to panel 440 to move the panel 440 in two directions opposite to each other. Movement mechanisms 450, 460, 470 and 480 include actuators 452 and 454, 462 and 464, 472 and 474, and 482 and 484, respectively. In one embodiment, each of the actuators passes from the interior to the exterior of the shell through a respective opening in the shell 402 and may include a pull at its distal end.

When a user pulls downwardly on actuators 452 and 454, rear panel 430 moves along the direction of arrow "H" (see FIG. 17). The user can pull on actuators 452 and 454 sufficiently so that the panel 430 is aligned with and blocks opening 416. When the user pulls downwardly on actuators 462 and 464, rear panel 430 moves along the direction of arrow "I." The extent to which the user pulls on actuators 462 and 464 or actuators 452 and 454 determines how much of the rear opening 416 is not covered by the panel 430.

When a user pulls downwardly on actuators 472 and 474, front panel 440 moves along the direction of arrow "G." When the user pulls downwardly on actuators 482 and 484, the front panel 440 moves upwardly along the direction of arrow "F." The user can pull actuators 482 and 484 so that a portion or all of the opening 414 is blocked. The amount of opening 414 that is not blocked or covered by panel 440 is determined by how far the user pulls actuators 472 and 474 downwardly.

The garment 400 includes guides 486 and 488 that are engaged by actuators 482 and 484, respectively. The guides 486 and 488 enable both movement mechanisms 450 and 460 associated with panel 440 to be disposed on the front side of the garment 400.

Figure 18:
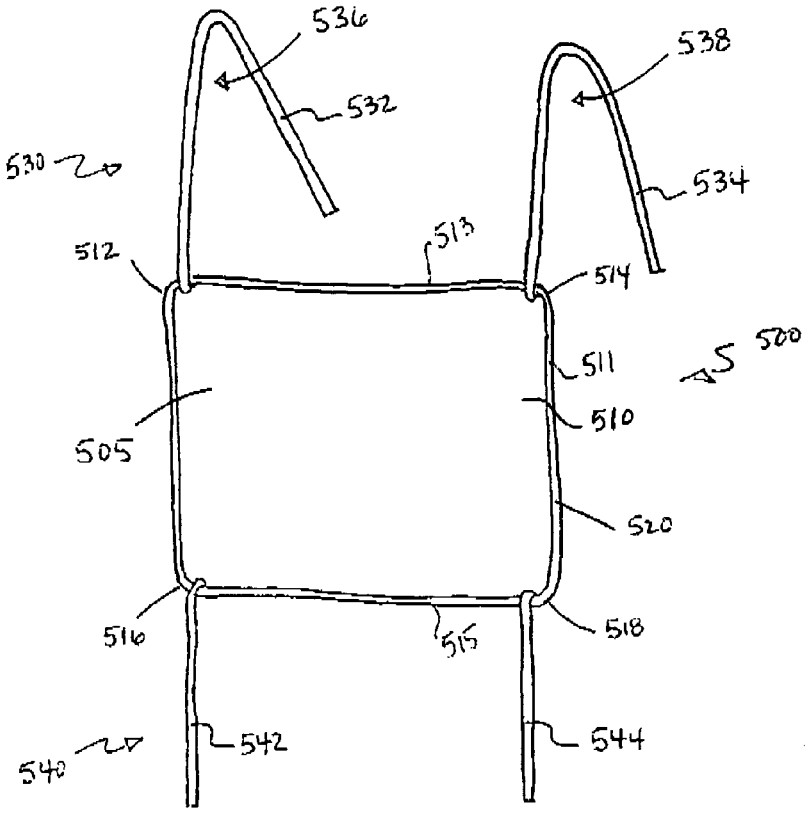
FIG. 18 is a front view of an embodiment of a controlling mechanism according to the invention.
Figure 19:
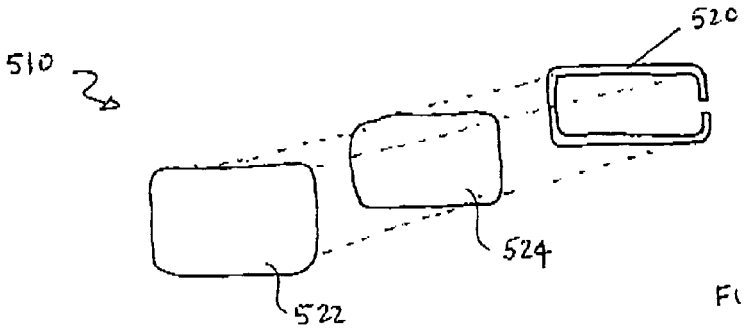
FIG. 19 is an exploded perspective view of some components of the controlling mechanism illustrated in FIG. 18.

An embodiment of a controlling mechanism is illustrated in FIGS. 18 and 19. In this embodiment, the controlling mechanism 500 includes a panel 505 that has a body portion 510 with ends and corner portions 512, 514, 516 and 518. The panel 505 includes a binding or piping 520 that is coupled along the perimeter 511 of the body portion 510. The perimeter 511 includes a first perimeter portion 513 and a second perimeter portion 515 opposite portion 513.

In an alternative embodiment, the panel 505 can include a material, such as Teflon®, disposed about all or a portion of the perimeter to reduce the friction generated between the panel 505 and components of the shell as the panel 505 moves.

Referring to FIG. 19, the panel 505 includes a first portion 522 and a second portion 524, which are coupled together by a binding 520 that is sewn around the perimeter of the portions 522 and 524.

Referring to FIG. 18, the controlling mechanism 500 includes movement mechanisms 530 and 540 that are coupled to the panel 505. Movement mechanism 530 includes actuators 532 and 534 that are coupled to the panel 505 proximate corners 512 and 514, respectively. Actuators 532 and 534 are illustrated with curved portions 536 and 538, which represent the configurations of the actuators 532 and 534 over a user's shoulders. In that arrangement, the actuators 532 and 534 extend through a shoulder region of a garment. Actuators 532 and 534 are flexible, elongate members.

Movement mechanism 540 includes actuators 542 and 544 that are coupled to the panel 505 proximate corners 516 and 518, respectively. In the construction of this embodiment, an end of each of the actuators 532, 534, 542 and 544 is placed underneath the binding 520, which is then coupled to the body portion 510 to couple the actuators. The actuators 532 and 534, and 536 and 538 are coupled to the first and second perimeter portions 513 and 515 of the panel 505, respectively.

In alternative embodiments, the panel can include a single layer of material. Alternatively, multiple pieces of material can be stitched together instead of using binding. Also, the actuators of the movement mechanisms can be coupled to the movable layer at any locations and using any known coupling technique or method.

Figure 20:
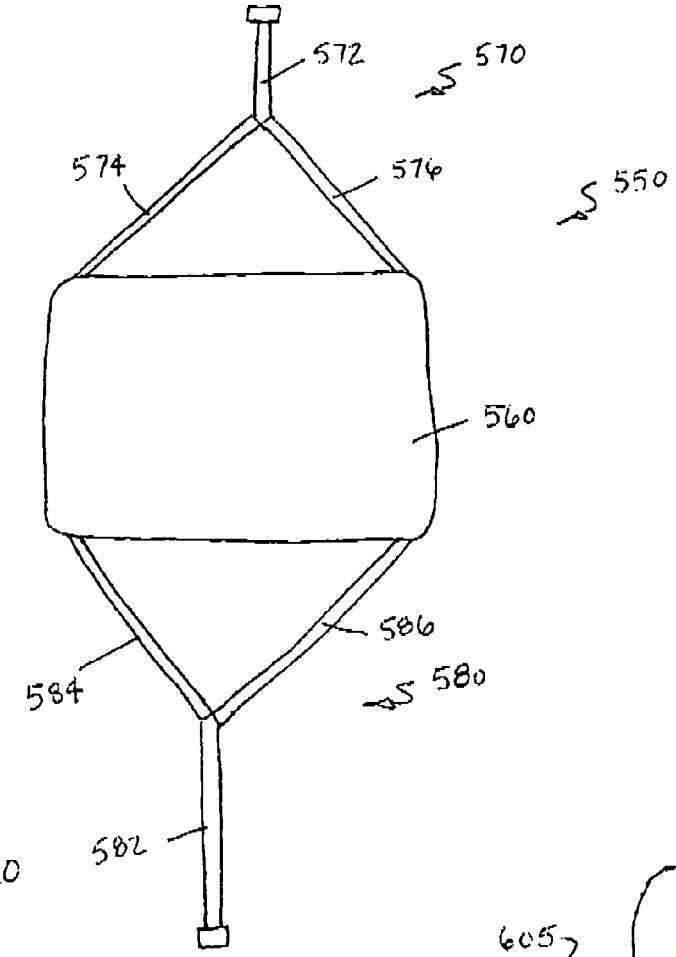
FIG. 20 is a front view of an alternative embodiment of a controlling mechanism according to the invention.

An alternative embodiment of a controlling mechanism is illustrated in FIG. 20. In this embodiment, the controlling mechanism 550 includes a panel 555 having a body portion 560. A movement mechanism 570 is coupled to one portion or end of the body portion 560. Another movement mechanism 580 is coupled to an opposite portion or end of the body portion 560.

In this embodiment, movement mechanism 570 includes a common actuator or actuator portion 572 and two coupling actuators or actuator portions 574 and 576. Similarly, movement mechanism 580 includes a common actuator or actuator portion 582 and two coupling actuators or actuator portions 584 and 586. The user can pull selectively on portion 572 or portion 582 to move the panel 550 in the desired direction relative to an opening in the garment.

Figure 21:
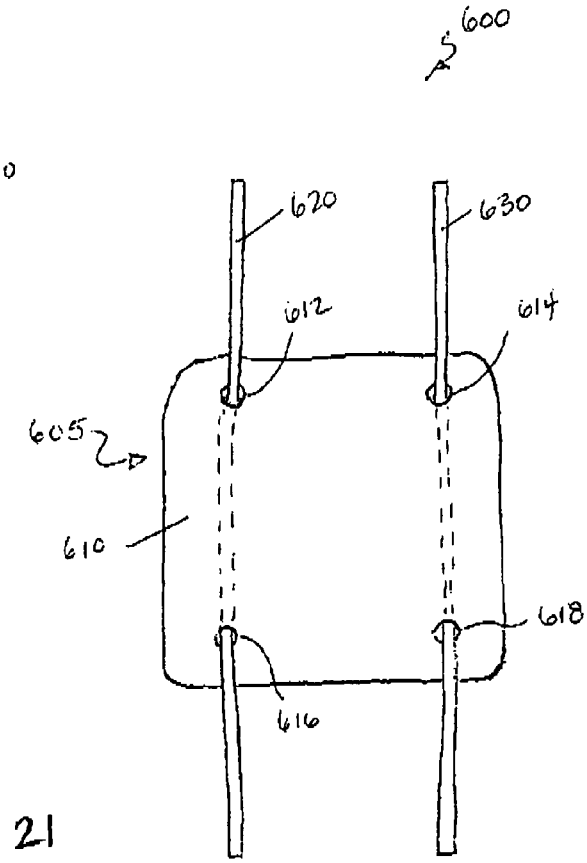
FIG. 21 is a front view of an alternative embodiment of a controlling mechanism according to the invention.

An alternative embodiment of a controlling mechanism is illustrated in FIG. 21. In this embodiment, the controlling mechanism 600 includes a panel 605 with a body portion 610 that has several holes 612, 614, 616 and 618. The locations and configurations of the holes can vary.

The controlling mechanism 600 includes an actuator 620 that can be inserted through holes 612 and 616. The actuator 620 can be coupled to the body portion 610 using any known technique, such as an adhesive, sewing, taping, etc.

The controlling mechanism 600 also includes an actuator 630 that can be inserted through holes 614 and 618. The actuator 630 can be coupled to the body portion 610 in a similar manner as actuator 620. Coupling of the actuators 620 and 630 to body portion 610 prevents the body portion 610 from moving relative to the actuators 620 and 630.

Figure 22:
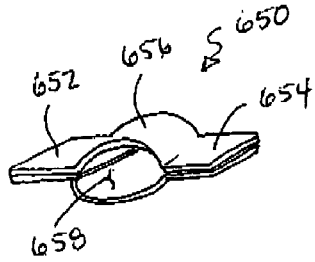
FIG. 22 is a perspective view of an embodiment of a guide according to the invention.

An embodiment of a guide according to the invention is illustrated in FIG. 22. In this embodiment, the guide 650 includes mounting portions 652 and 654 and a body portion 656. The body portion 656 defines a channel 658 through which an actuator can be inserted. The mounting portions 652 and 654 of the guide 650 can be coupled to the garment using any known technique. The guide 650 is used to control the direction and orientation of an actuator. In one implementation, the guide 650 is coupled to the garment proximate to the shoulder region of a garment.

Figure 23:
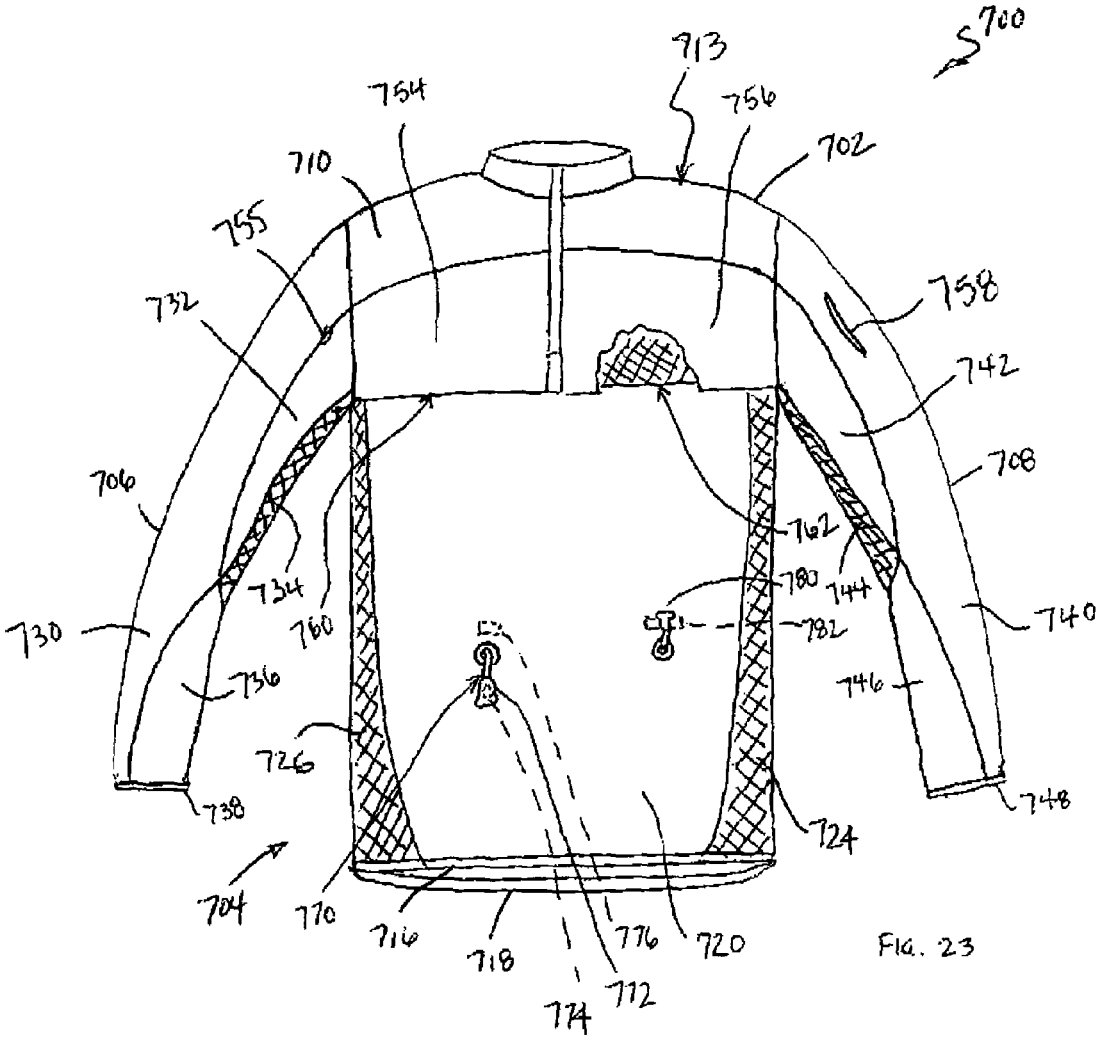
FIG. 23 is a front view of an alternative embodiment of a garment according to the invention.
Figure 24:
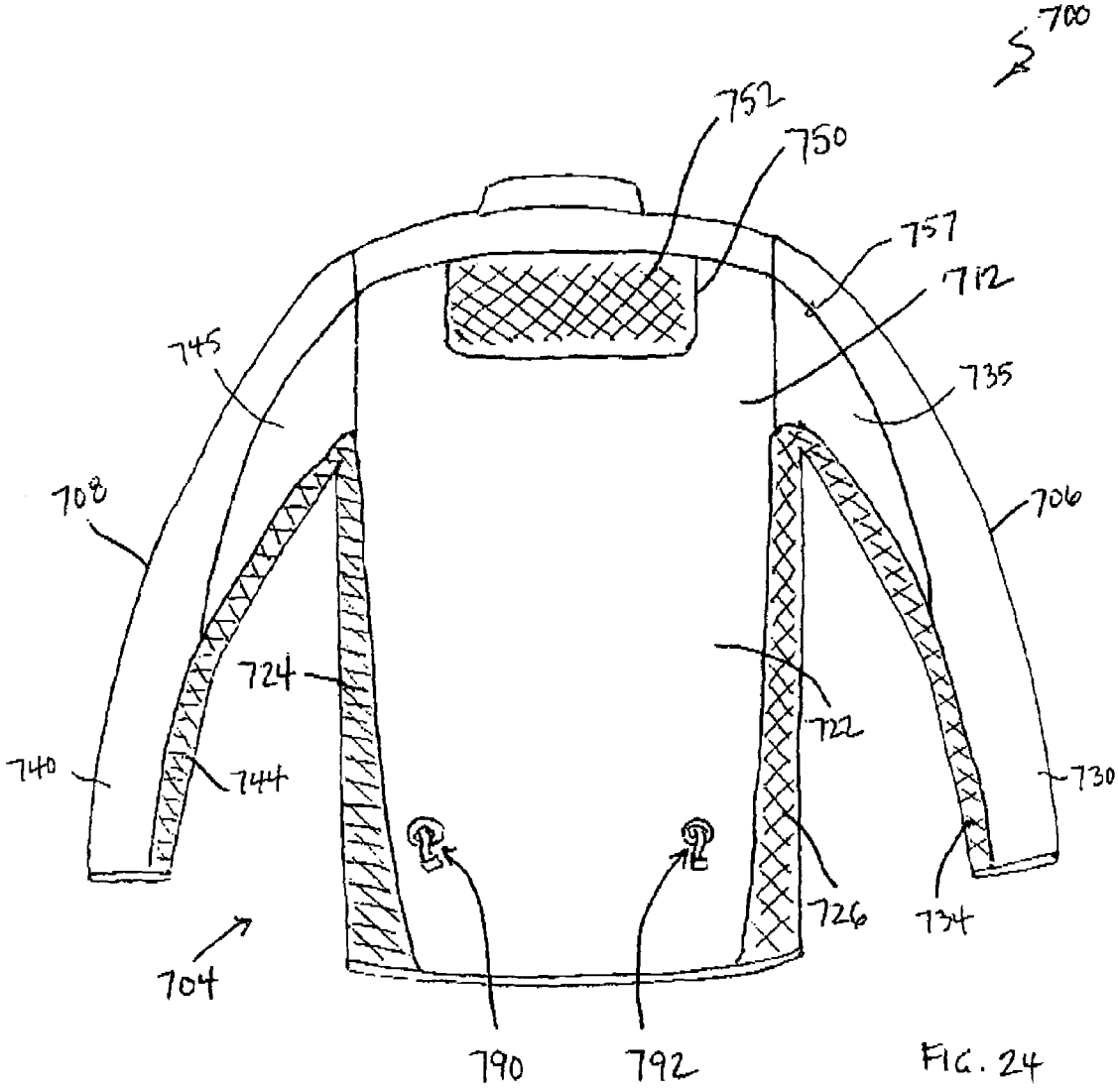
FIG. 24 is a rear view of the garment illustrated in FIG. 23.

An alternative embodiment of a garment is illustrated in FIG. 23. In this embodiment, the garment 700 includes a shell 702 that has a torso region 704 and sleeves 706 and 708. The shell 702 has a front portion 710, a rear portion 712 and a shoulder region 713. The front portion 710 of the torso region 704 has a lower end 716 and the rear portion 712 of the torso region 704 has a lower end 718. The lower ends 716 and 718 are at the opposite end of the shell 702 from the shoulder region 713. In this embodiment, the lower end 718 of the rear portion 712 extends lower than the lower end 716 of the front portion 710. Referring to FIG. 24, the rear portion 712 includes an opening 750 that has an air permeable material 752, such as mesh, disposed therein.

The torso region 704 includes a front panel 720, a rear panel 722 (see FIG. 24) and side panels 724 and 726. The front panel 720 and rear panel 722 are disposed between and coupled to the side panels 724 and 726 by sewing. In this embodiment, the front panel 720 and rear panel 722 are made of a polyester material. The side panels 724 and 726 are made of an air permeable material, such as mesh material made of polyester. The side panels are gussets that eliminate the need for a side seam and for a seam under the sleeves.

The air permeability characteristic of a particular material indicates how much air flows through the material. The user may desire materials of different air permeability in different locations of the garment, depending on the desired air flow and cooling characteristics. In one embodiment, the air permeability of the side panels 724 and 726 constructed from mesh is less than that of the material 752 used in opening 750 in the rear portion 712.

The garment 700 includes front flaps 754 and 756 that are not coupled at their lower ends to the torso region 704 of the garment 700. Beneath each flap 754 and 756 is an air permeable material (see reference 762 in the cut-away portion of FIG. 23) that is in communication with the interior region of the garment. Air is permitted to flow under the unattached ends of the flaps 754 and 756, through the underlying air permeable material and into the interior region of the garment 700.

Referring to FIGS. 23 and 24, the garment 700 includes sleeves 706 and 708. Each of the sleeves 706 and 708 is made of several panels of different materials. Sleeve 706 and sleeve 708 are substantially similar and are mirror images of each other. Due to the pieces that make up the sleeves, the sleeves have a pre-molded or pre-curved configuration.

Sleeve 706 includes panels 730, 732 and 735, which are constructed from known nylon material. Sleeve 706 includes an air permeable material panel 734 that is coupled to panels 730, 732 and 735. Finally, the sleeve 706 includes an absorbent panel 736 that is made of a hydrophilic material. The distal end of the sleeve 706 has a binding 738 around the cuff portion that couples the ends of the relevant panels together.

Similarly, sleeve 708 includes panels 740, 742 and 745, an air permeable material panel 744 and an absorbent panel 746. The distal end of the sleeve 708 has a binding 748 around the cuff portion that couples the ends of the relevant panels together.

Sleeve 708 includes an opening 758 that is in communication with an internal pocket (not shown) in panel 740 of the sleeve 708. The pocket can be a mesh material that is coupled to an inner surface of the outer layer proximate to opening 758. In one embodiment, an expanding mechanism can be disposed proximate to opening 758 so that when a closure mechanism, such as a zipper, is opened, the expanding mechanism causes the pocket to open. In an alternative embodiment, the opening and pocket can be located on any panel of either sleeve. In one embodiment, the garment 700 can also include piping 755 and 757 (see FIG. 24), which can be made of a reflective material, that is disposed along the seams between adjacent panels.

The garment 700 includes a controlling mechanism that has a front movement mechanism and a rear movement mechanism. Each of the movement mechanisms are coupled to an internal panel (not shown). The front movement mechanism includes actuator 770 and actuator 780. In this embodiment, actuator 770 includes a pull 772 that has an internal magnet 774 (shown in phantom). The torso region 704 includes a metallic component 776 coupled to the shell 702. The coupling of the magnet 774 and the metallic component 776 secures the pull 772 to the outer surface of the garment 700, thereby reducing any movement of the actuator 770 and pull 772 during activities.

The garment 700 includes movement mechanisms that are coupled to an internal movable layer (not shown). Actuator 780 includes a pull 782 that has an internal magnet (not shown). The torso region 704 also includes a metallic component 782. The coupling of the magnet and the metallic component 782 secures the pull 782 to the outer surface of the garment 700, thereby reducing any movement of the actuator 780 and pull 782 during activities. The garment 700 also includes actuators 790 and 792 which are disposed on the rear portion 712 of the torso region 704. In an alternative embodiment, the locations of the magnet and metallic component can be reversed. Alternatively, the pull and the garment can each include a magnet.

Figure 25:
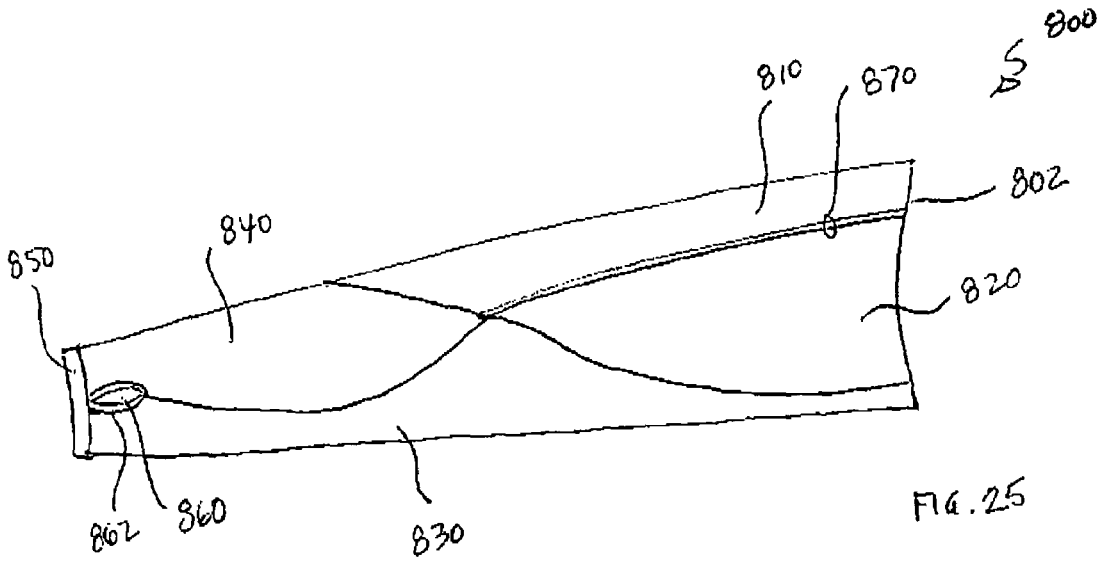
FIG. 25 is a front view of an embodiment of a sleeve according to the invention.
Figure 26:
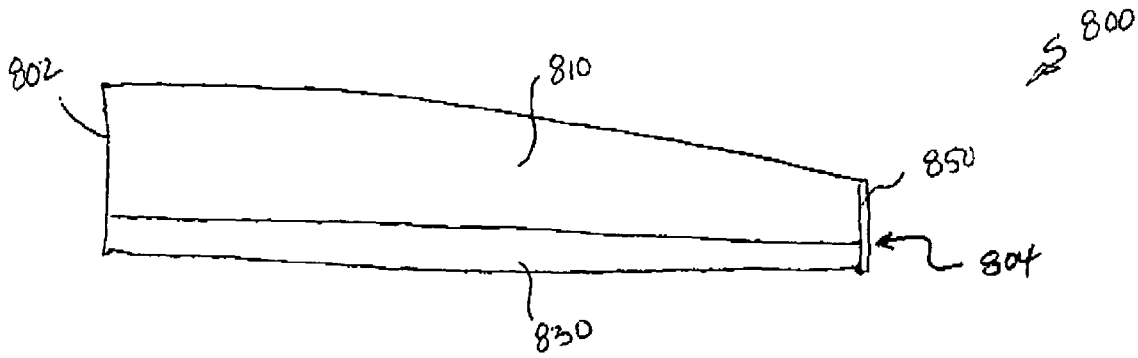
FIG. 26 is a rear view of the sleeve illustrated in FIG. 25.
Figure 27:
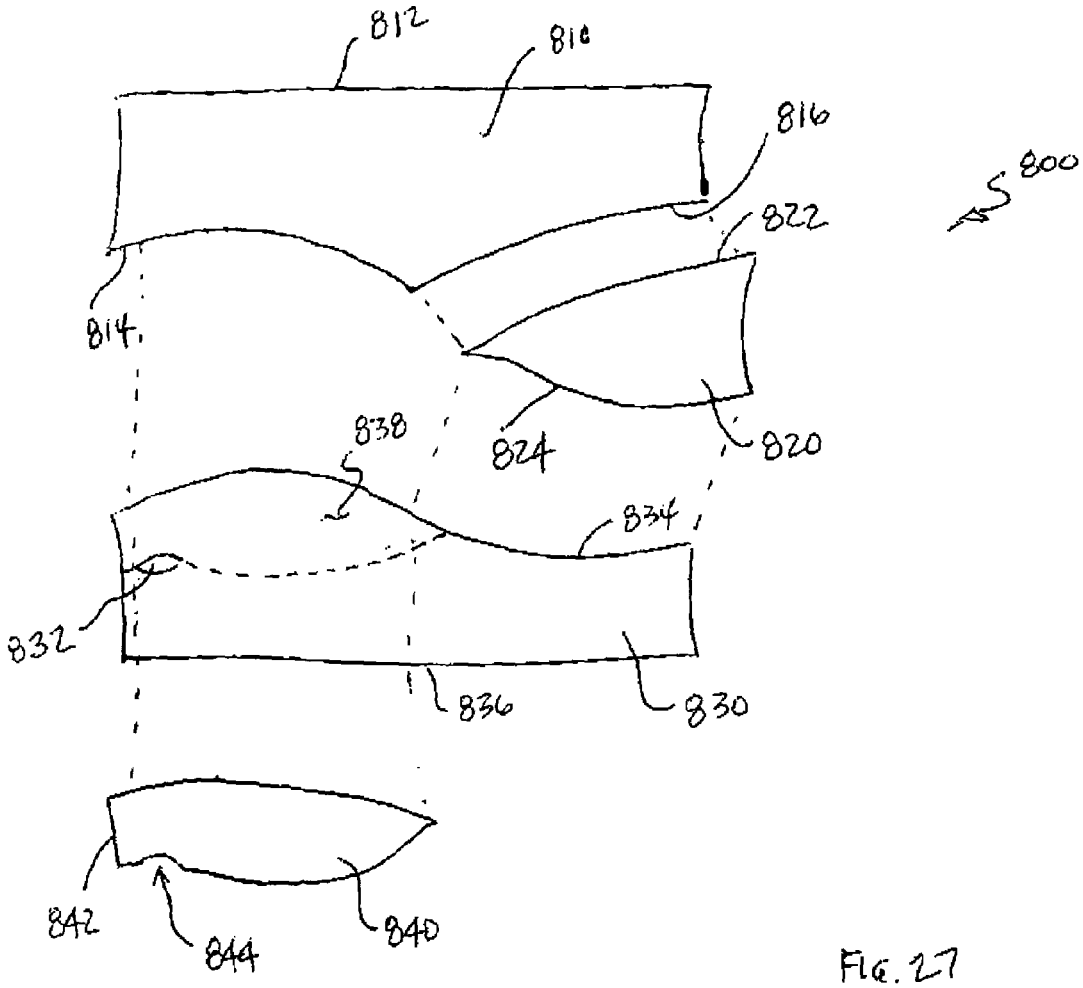
FIG. 27 is an exploded view of the sleeve illustrated in FIG. 25.
Figure 29:
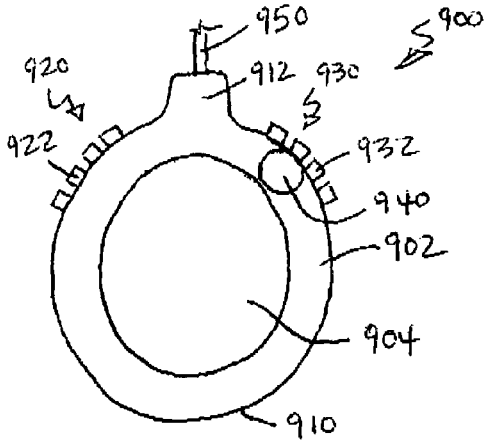
FIG. 29 is a front view of the pull illustrated in FIG. 28.
Figure 30:
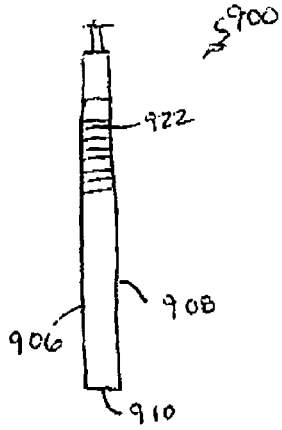
FIG. 30 is a side view of the pull illustrated in FIG. 28.
Figure 31:
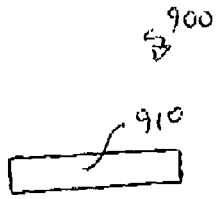
FIG. 31 is a bottom view of the pull illustrated in FIG. 28.
Figure 32:
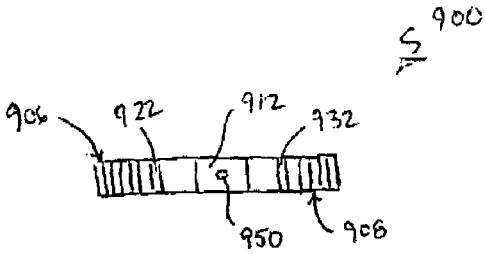
FIG. 32 is a top view of the pull illustrated in FIG. 28.

An embodiment of a sleeve according to the invention is illustrated in FIGS. 25-27. In this embodiment, the sleeve 800 includes several panels of different material that are coupled together. The sleeve 800 includes an end 802 coupled to the torso region of a garment and an opposite, distal end 804.

Sleeve 800 includes panels 810, 820, 830 and 840. Panels 810 and 820, for example, are made of a windproof, nylon material, and can be coupled together by sewing. Piping 870 is subsequently coupled to the seam of the panels 810 and 820.

Panel 830, for example, is made of an air permeable material and panel 840 is an absorbent panel. Panel 840 can be constructed from a suede material. The distal end of the sleeve 800 has a binding 850 around the cuff portion that couples the ends of the relevant panels together.

As illustrated in FIGS. 25 and 27, the sleeve 800 includes a thumb opening 860 formed therein. The opening 860 is defined by a binding 862 that extends around the circumference of the opening 860.

Referring to FIG. 27, panel 810 includes edges 812, 814 and 816, and panel 820 includes edges 822 and 824. Edges 816 and 822 are coupled together using any known technique, such sewing and/or a binding.

Panel 830 includes edges 834 and 836, an opening 832 and a covered region 838. Opening 832 is configured to receive the thumb of the user and can have any shape or configuration. Edge 834 is coupled to edge 824 and edge 814 using any known technique. Similarly, edge 836 is coupled edge 812.

Panel 840 of the sleeve 800 is disposed on the covered region 838 of panel 830. Panel 840 includes a distal end 842 and a recess 844 that is aligned with opening 832 when panel 840 is disposed on the covered region 838 of panel 830. Panels 840 and 830 can be coupled by sewing, an adhesive, etc. In an alternative embodiment, the absorbent panel may not include any opening or recess.

Figure 28:
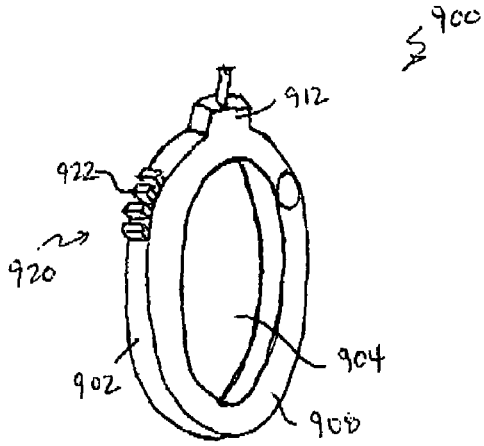
FIG. 28 is a perspective view of an embodiment of a pull according to the invention.

An embodiment of a pull according to the invention is illustrated in FIGS. 28-32. The pull 900 facilitates the grasping and manipulation of actuator 950. As illustrated in FIG. 28, the pull 900 includes a body portion 902 that defines a centrally located opening 904. The body portion 902 has sides 906 and 908 (see FIG. 30), a lower end 910 and an upper end 912. The actuator 950 can be coupled to the upper end 912 using any known technique. The body portion 902 includes two gripping regions 920 and 930 that include several ridges or bumps 922 and 932, respectively (see FIG. 29). The ridges 922 and 932 provide additional traction and friction for the user's fingers.

In one implementation, the body portion 902 may include a portion 940 that is a different color from the remainder of the body portion 902. For example, portion 940 can be red and the remainder of the body portion 902 can be black.

An alternative embodiment of a controlling mechanism is illustrated in FIGS. 33-35. FIG. 33 includes a line that illustrates the exterior and interior of a garment (not shown). The controlling mechanism 1000 includes a movement mechanism 1005 and a movable panel 1050. The movement mechanism 1005 is coupled to the panel 1050 and extends from the interior to the exterior of the garment.

In this embodiment, the movement mechanism 1000 includes an actuator 1010 that is coupled to a portion of the movable panel 1050. While actuator 1010 is illustrated as being coupled to a corner of the panel 1050, in other embodiment, the actuator can be coupled to the panel at any location.

The actuator 1010 includes a first end 1012 that is coupled to the panel 1050 and a second end 1014 to which a pull 1020 is coupled. The second end 1014 of the actuator 1010 is disposed outside of the garment. The actuator 1010 is an elongate member that is substantially inelastic.

The movement mechanism 1000 also includes a retractor 1030 that is coupled to the shell of a garment and coupled to the actuator 1010. The retractor 1030 biases the actuator 1010 inwardly with respect to the shell when actuator 1010 is extended by a user.

The retractor 1030 includes a first end 1032 that is coupled to an inner location of the shell. For example, the retractor 1030 can be coupled to the inner layer and at any location using any known technique. The retractor 1030 includes a second end 1034 that is coupled to the actuator 1010.

In one embodiment, the second end 1034 can be heat shrunk or otherwise welded or melted onto the actuator 1010 (see reference 1040 in FIG. 35). The retractor 1030 can be any material that has elastic properties such that it returns to an unbiased state after forces on the actuator 1010 and the retractor 1030 are no longer applied. In one embodiment, the retractor is an elastic drawcord.

In FIG. 33, the panel 1050 and the actuator 1010 are illustrated in their first configurations 1052 and 1002, respectively. In this arrangement, the retractor 1030 is shown in its unbiased or retracted configuration.

As illustrated in FIG. 34, when a user grasps the pull 1020 and moves the pull 1020 along the direction of arrow "J" to its second configuration 1004, movement of the actuator 1010 causes the panel 1050 to move from its first configuration 1052 to another configuration 1054. Simultaneously, end 1032 remains substantially fixed and the retractor 1030 is stretched as illustrated. When the user releases the pull 1020, the retractor 1030 returns to its unbiased configuration and the amount of the actuator 1010 that extends out from the garment is reduced.

Figure 36:
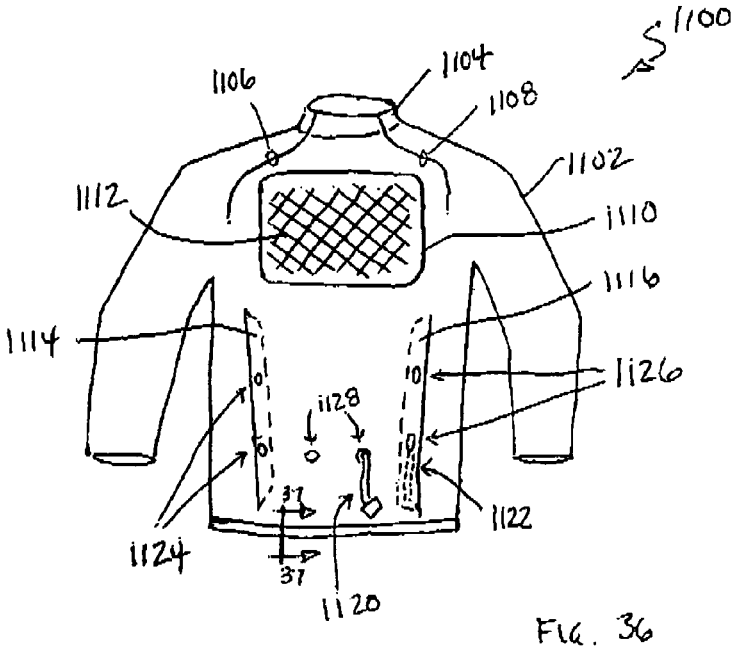
FIG. 36 is a front view of an alternative embodiment of a garment according to the invention.
Figure 37:
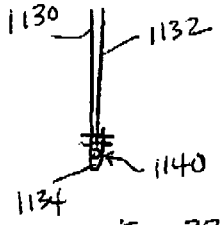
FIG. 37 is a cross-sectional side view of some components of the garment illustrated in FIG. 36 taken along the line "37-37".
Figure 38:
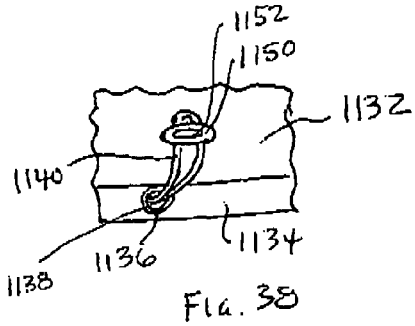
FIG. 38 is a partial sectional view of some internal components of the garment illustrated in FIG. 36.

An alternative embodiment of a garment is illustrated in FIGS. 36-38. In this embodiment, the garment 1100 includes a shell 1102 that has a collar 1104 and closure mechanisms 1106 and 1108. In this configuration, the closure mechanisms 1106 and 1108 have a curved configuration and extend downwardly from the collar 1104 and toward the sides of the garment.

The garment 1100 includes a torso region that has an opening 1110 formed therein. The opening 1110 includes an air permeable material 1112, such as mesh, disposed therein.

As previously illustrated and discussed, a garment can have multiple holes or opening on the torso region to accommodate several actuators that can be manipulated to move one or more panels. In this embodiment, hole pairs 1124, 1126 and 1128 are disposed on the torso region.

In this embodiment, the torso region includes flaps 1114 and 1116 that are formed by folding over extra material and forming a cover over holes 1124 and 1126. Thus, the flaps 1114 and 1116 cover the corresponding holes, thereby hiding them from sight.

An exemplary actuator 1120 is shown. Although not shown, actuators are provided for all of the holes 1124, 1126 and 1128. Another exemplary actuator 1122 is illustrated in FIG. 36 as being located behind flap 1116. The user can access any actuator disposed beneath a flap by reaching underneath the outside edge of the flap.

In this embodiment, the shell 1102 includes an outer layer 1130 and an inner layer 1132. The lower end of the outer layer 1130 is folded under and coupled to the inner surface of the inner layer 1132 by sewing or stitching as shown. A channel 1134 is formed by the outer layer 1130 and a cord 1140 is disposed therein.

Referring to FIG. 38, an opening 1136 is formed on the inner surface of and in communication with the channel 1134. A grommet 1138 is associated with the opening 1136. The cord 1140, which in this embodiment, has elastic properties, extends out of opening 1136 and passes through a retaining mechanism 1150. Retaining mechanism 1150 is a known position locking device that can slide along the cord 1140 and that has a locking configuration relative to the cord 1140. The mechanism 1150 includes a push button 1152 that can be manipulated to release the mechanism 1150 from its locking configuration and to allow it to slide along the cord 1140.

Figure 39:
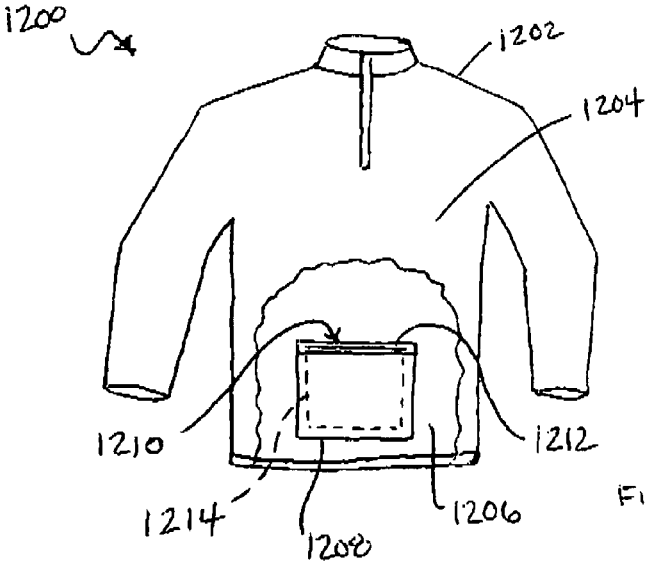
FIG. 39 is a front view of an alternative embodiment of a garment illustrating some of the internal components.
Figure 40:
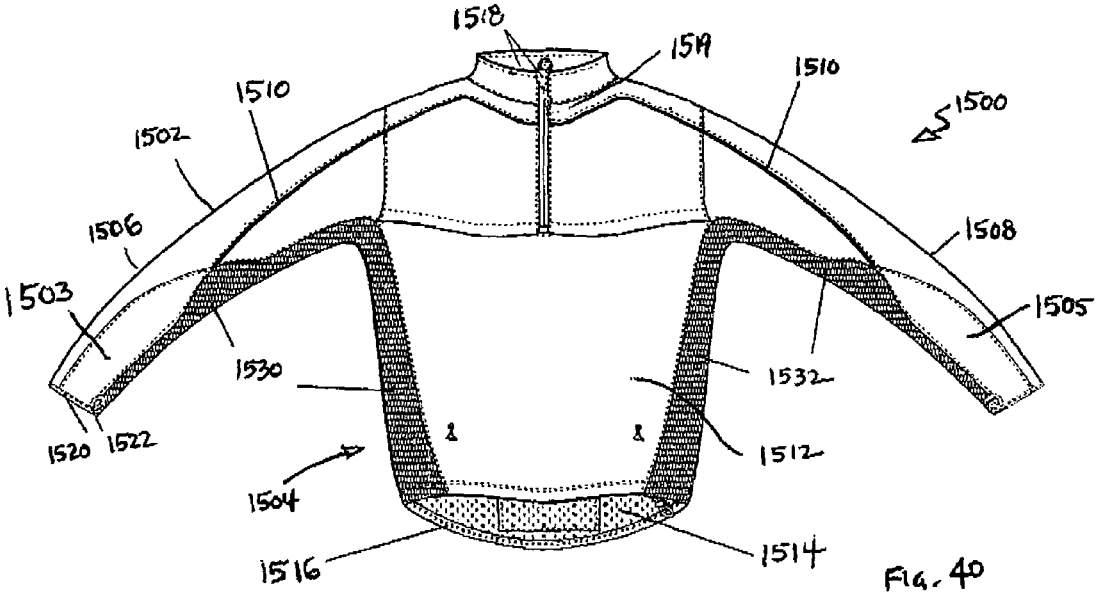
FIG. 40 is a front view of an alternative embodiment of a garment according to the invention.

An alternative embodiment of a garment is illustrated in FIG. 39. In this embodiment, the garment 1200 includes a shell 1202 that has a torso region 1204. A portion of front of the torso region 1204 is shown in cut-away removed to facilitate the illustration of some internal components of the garment 1200. The garment 1200 includes an inner surface 1206 that has a pouch 1208 coupled thereto. The pouch 1208 can be coupled to the surface 1206 by stitching 1214. The pouch 1208 includes an opening 1210 that can be opened and closed via a closure mechanism 1212, such as a zipper.

A user can turn the garment 1200 inside out and fold it up so that the garment 1200 can be inserted into the pouch 1208. The pouch 1208 is sized so that it can receive the entire garment 1200. This configuration allows for easy transportation and even washing of the garment 1200.

An alternative embodiment of a garment is illustrated in FIGS. 40-45. In this embodiment, the garment 1500 includes a shell 1502 that has a torso region 1504 and sleeves 1506 and 1508. Several panels of the shell 1502 are coupled together by stitching and in some cases, piping 1510 that extends across the front and rear of the garment 1500.

The garment 1500 includes an outer layer 1512 that includes air permeable panels 1530 and 1532, such as mesh, that extend along the torso region 1504 and a portion of the sleeves 1506 and 1508. Sleeves 1506 and 1508 include absorbent panels 1503 and 1505, respectively. The garment 1500 includes a rear inner layer 1514 that is formed of an air permeable material, such as mesh. The garment 1500 also includes a textured material 1518 along the collar that provides comfort to the user. A closure mechanism 1519, such as a zipper, is associated with the collar.

The garment 1500 includes a binding 1520 that is sewn along the distal ends of the sleeves 1506 and 1508, and a binding 1522 that is sewn along the perimeter of the thumb opening in each sleeve.

Figure 41:
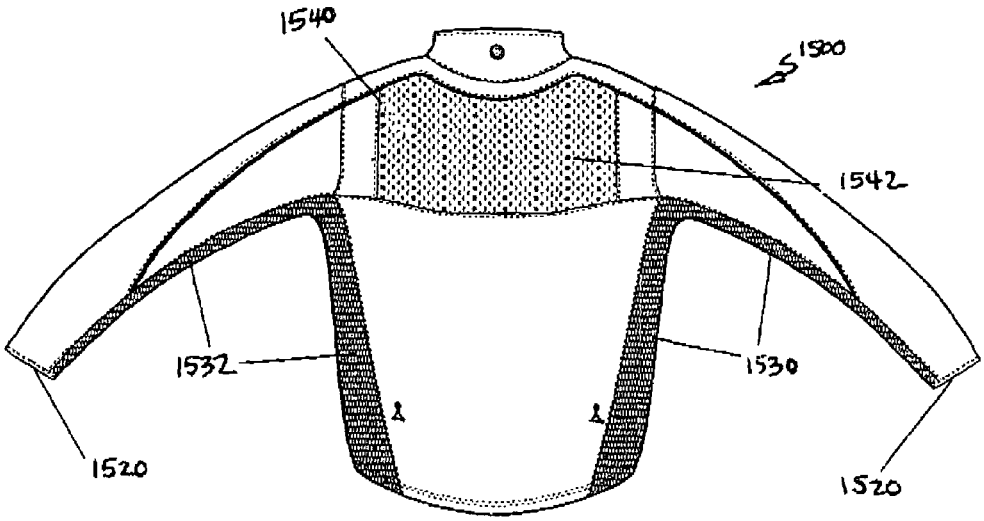
FIG. 41 is a rear view of the garment illustrated in FIG. 40.

Referring to FIG. 41, a rear view of the garment 1500 is illustrated. The garment 1500 includes an opening 1540 in its rear portion. An air permeable material 1542, such as mesh, covers the opening 1540.

Figure 42:
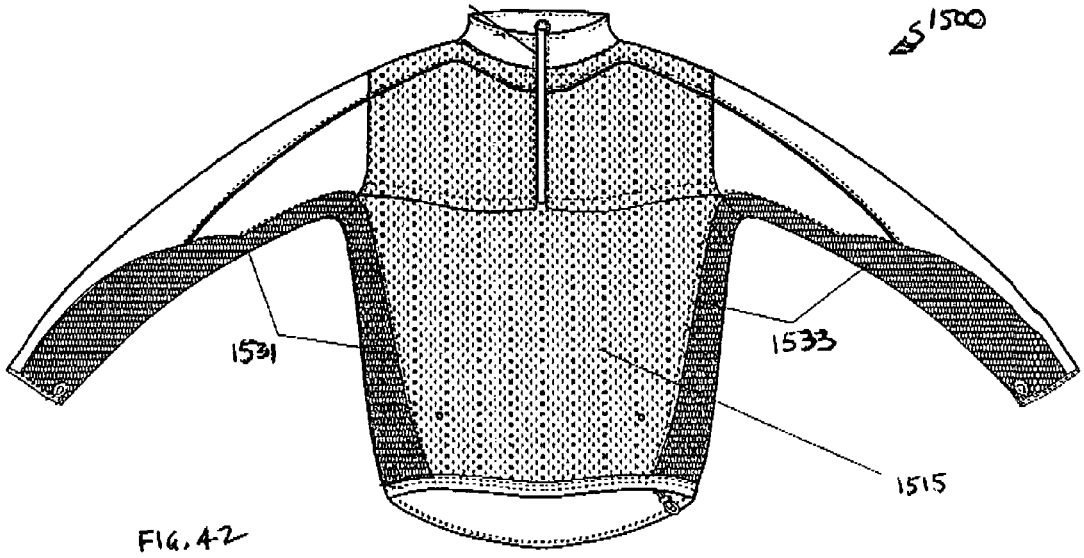
FIG. 42 is a front view of the garment illustrated in FIG. 40 turned inside out.

Referring to FIG. 42, a front view of the garment 1500 after it has been turned inside out is illustrated. The air permeable panels 1530 and 1532 have inner surfaces 1531 and 1533 as shown. The garment 1500 includes a front inner layer 1515 that is coupled to the outer layer of the garment 1500 using any known technique, such as sewing.

Figure 43:
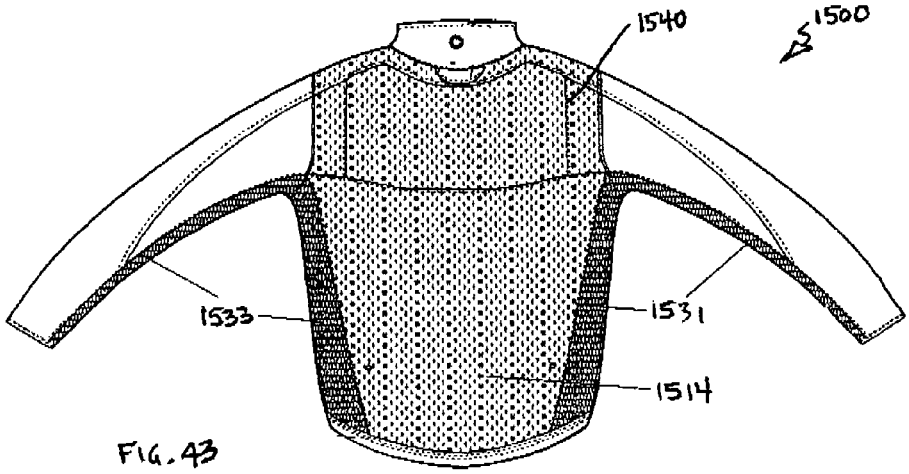
FIG. 43 is a rear view of the garment illustrated in FIG. 40 turned inside out.

Referring to FIG. 43, a rear view of the garment 1500 after it has been turned inside out is illustrated. The garment includes a rear inner layer 1514 that is coupled to the outer layer of the garment 1500 as well.

Figure 44:
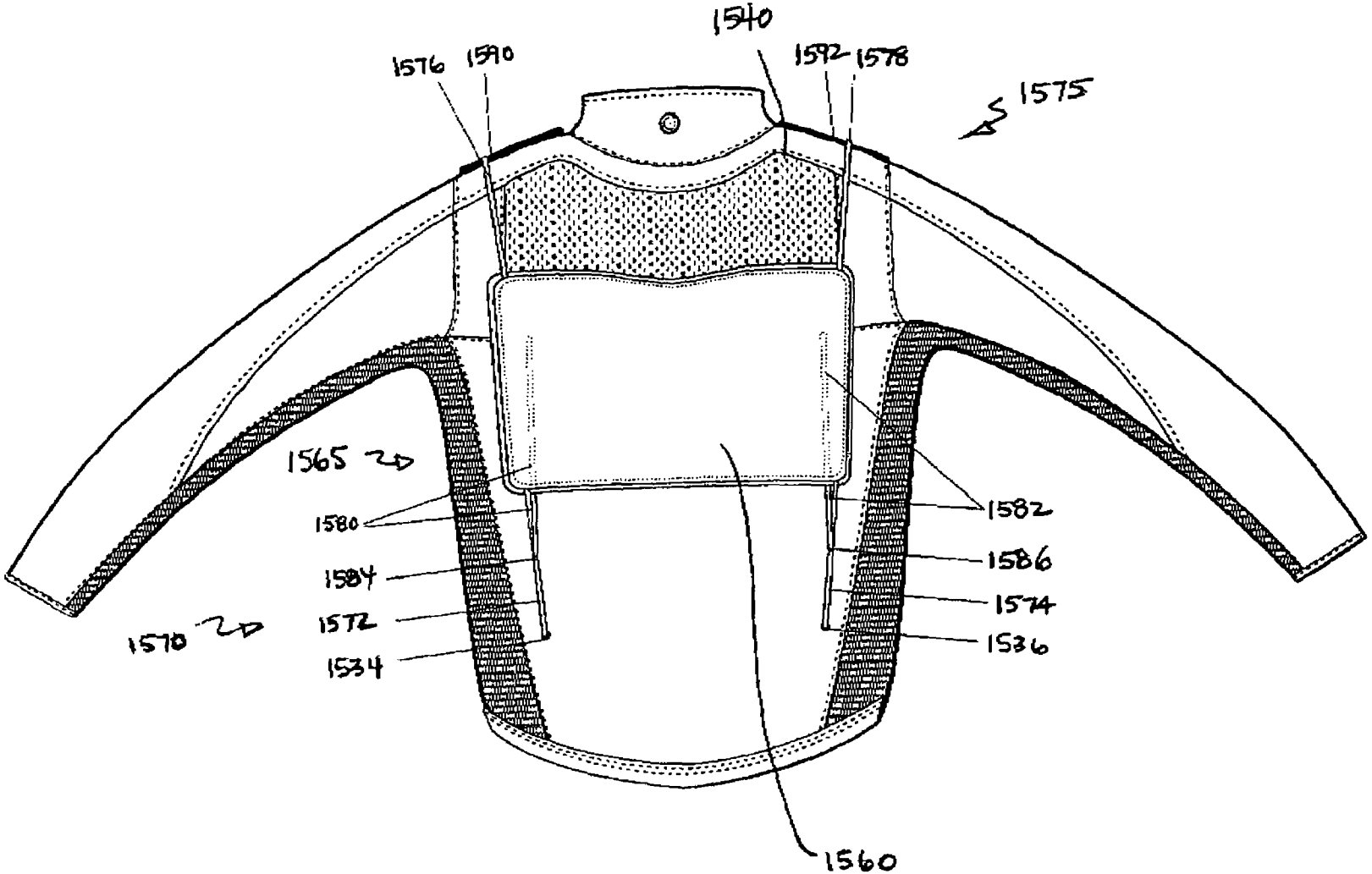
FIG. 44 is a rear view of the garment illustrated in FIG. 43 with the rear inner layer removed.

Referring to FIG. 44, a rear view of the garment 1500 after it has been turned inside out is illustrated. In this arrangement, the rear inner layer 1514 has been removed to facilitate the illustration and discussion of several components of the garment 1500.

Garment 1500 includes a movable panel or layer 1560 that can be selectively positioned relative to the opening 1540. In this embodiment, garment 1500 includes a controlling mechanism that has a movement mechanism 1570 that can be manipulated to move the panel 1560. Movement mechanism 1570 includes actuators 1572 and 1574 that extend from the interior to the exterior of the garment 1500 through holes 1534 and 1536. One end of each actuator 1572 and 1574 is coupled to the panel 1560. When a user pulls downwardly on the actuators 1572 and 1574, the panel 1560 moves downwardly.

The movement mechanism 1570 includes retractors 1580 and 1582 that bias or pull the actuators 1572 and 1574 inwardly. One end of retractor 1580 is coupled to the garment 1500 and the other end 1584 of retractor 1580 is coupled to the actuator 1572. Similarly, one end of retractor 1582 is coupled to the garment 1500 and the other end 1586 is coupled to actuator 1574.

The garment 1500 also includes a movement mechanism 1575 that is coupled to the panel 1560. Movement mechanism 1575 includes actuators 1576 and 1578 that extend upwardly over the user's shoulders and down the front of the garment 1500. When the user pulls on actuators 1576 and 1578, the movable layer 1560 moves upwardly along the rear of the garment 1500.

The garment 1500 includes guide structures 1590 and 1592 that are disposed in the shoulder region of the garment 1500. The guide structures 1590 and 1592 slidably receive and direct the actuators 1576 and 1578, respectively. The guide structures 1590 and 1592 increase the tension on the actuators 1576 and 1578, thereby retaining or holding the actuators 1576 and 1578 in place relative to the shell. As the actuators 1576 and 1578 are held in place, the panel does not move relative to the shell until the user manipulates the actuators.

Figure 45:
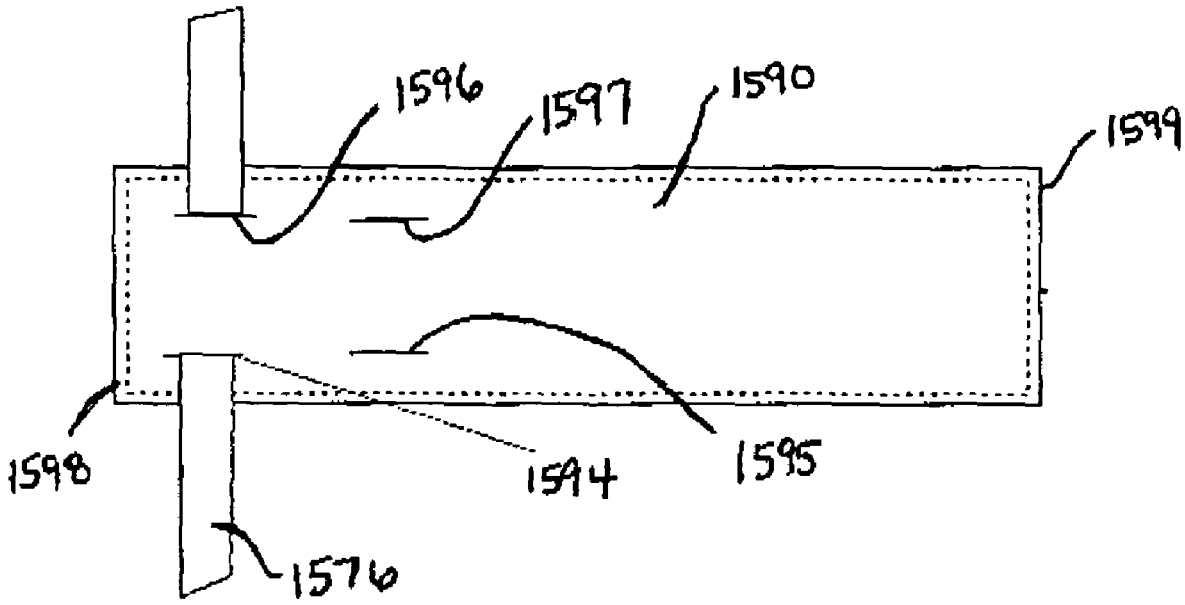
FIG. 45 is a plan view of the guide structure of the garment illustrated in FIG. 40.

An exemplary guide structure is illustrated in FIG. 45. Guide structure 1590 is a flexible, fabric member or membrane that is coupled to an inner surface of the garment 1500 or shell using any known technique, such as sewing. Guide structure 1590 is an elongate member with ends 1598 and 1599. The guide structure 1590 also includes several slits 1594, 1595, 1596 and 1597 through which an actuator can be inserted. For example, actuator 1576 is illustrated as inserted through slits 1594 and 1596.

In alternative embodiments, any type of friction generating structure that has an opening, such as a washer or o-ring, that is configured to provide tension on an actuator.

An alternative embodiment of a garment is illustrated in FIGS. 48-51. In this embodiment, the garment 1600 includes a shell 1602 with a torso region 1604 and sleeves 1606 and 1608. As shown in the front view illustrated in FIG. 46, the garment 1600 includes a front panel 1610 that has an outer surface 1612. The garment 1600 includes an opening 1614 that has an air permeable material and several side mesh panels 1617 and 1618.

Figure 47:
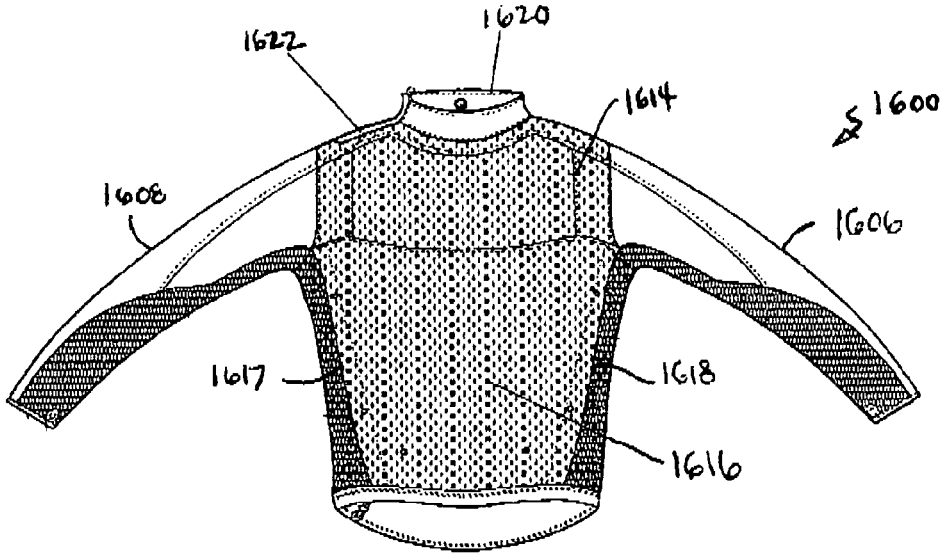
FIG. 47 is a front view of the garment illustrated in FIG. 46 turned inside out.

Referring to FIG. 47, a front view of the garment 1600 turned inside out is illustrated. The garment 1600 also includes a front inner layer 1616 that is coupled along its edges to various components of the shell 1602. For example, layer 1616 is coupled to panels 1617 and 1618. The front inner layer 1616 includes an inner surface 1619.

Figure 46:
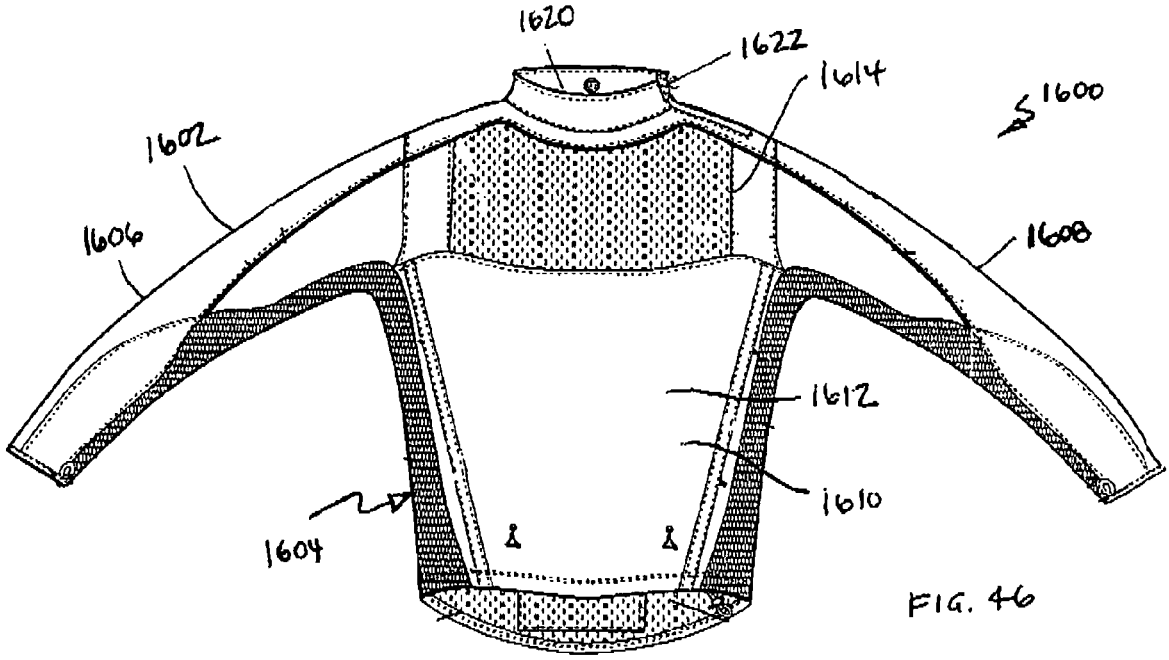
FIG. 46 is a front view of an alternative embodiment of a garment according to the invention.

As illustrated in FIGS. 46 and 47, the garment 1600 includes a collar 1620 and a closure mechanism 1622 that extends from the collar 1620 toward sleeve 1608. In an alternative embodiment, the garment can also include a closure mechanism that extends toward the other sleeve.

Figure 48:
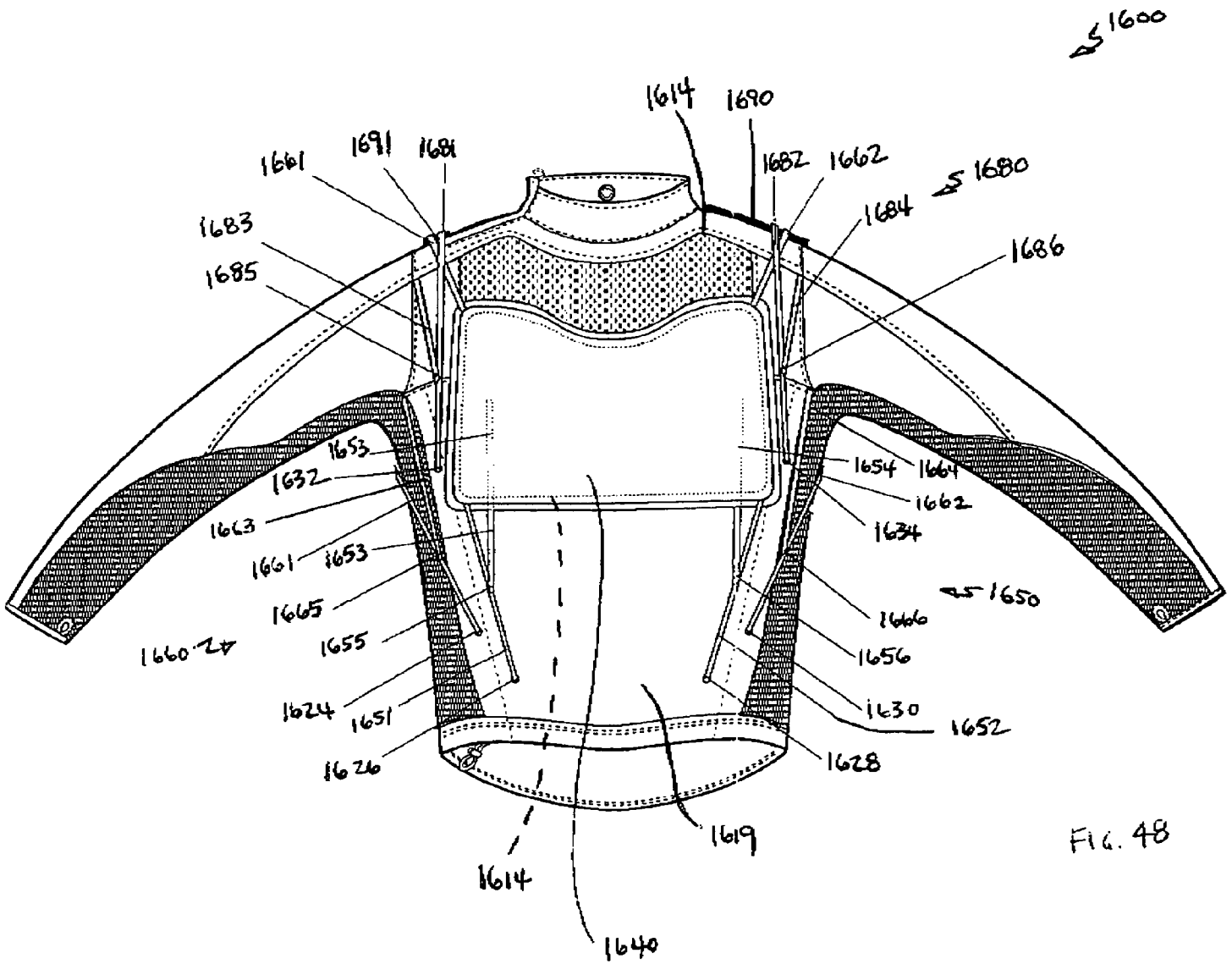
FIG. 48 is a front view of the garment illustrated in FIG. 47 with the front inner layer removed.
Figure 49:
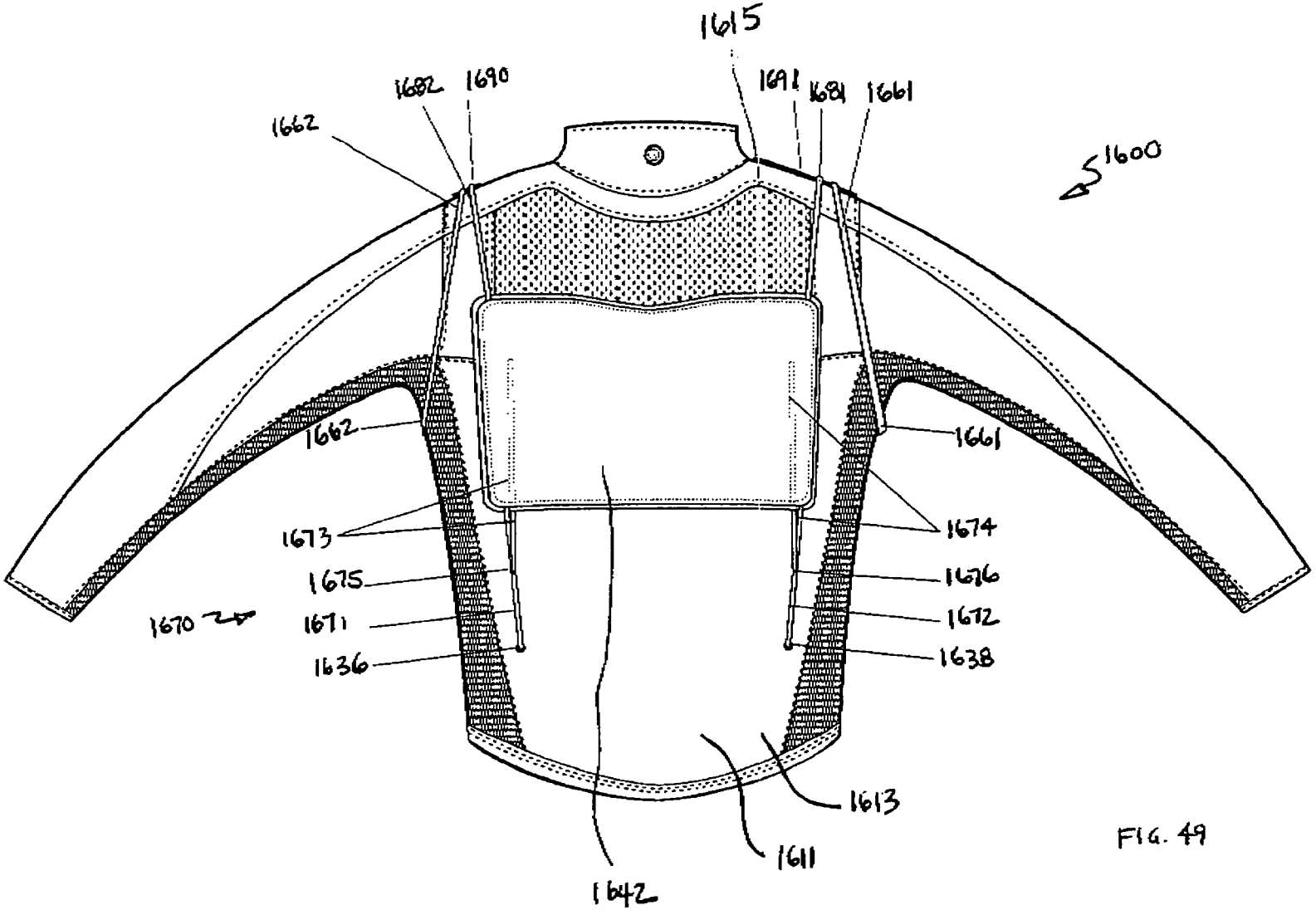
FIG. 49 is a rear view of the garment illustrated in FIG. 46 turned inside out with the rear inner layer removed.

Turning to FIGS. 48 and 49, the internal components of the garment 1600 are now discussed. FIG. 48 is a front view of the garment 1600 turned inside out with the front inner layer removed. Similarly, FIG. 49 is a rear view of the garment 1600 turned inside out with the rear inner layer removed.

In this embodiment, the garment 1600 includes a front opening 1614 and a rear opening 1615. Movable panels 1640 and 1642 are associated with openings 1614 and 1615, respectively. Each panel can be moved by a user to cover all, none or only a portion of the corresponding opening.

The garment 1600 includes a controlling mechanism with two movement mechanisms 1650 and 1660 that can be manipulated to move panel 1640. Movement mechanism 1650 can be used to move the panel 1640 downwardly to expose some or all of the opening 1614. Movement mechanism 1660 can be used to move the panel 1640 upwardly to cover some or all of the opening 1614.

Movement mechanism 1650 includes actuators 1651 and 1652, which extend outwardly from the shell 1602 through holes 1626 and 1628. Actuators 1651 and 1652 are coupled to the panel 1640. Each of the retractors 1653 and 1654 are coupled at one end to the shell 1600 and coupled to the actuators 1651 and 1652 at ends 1655 and 1656, respectively. When the user pulls downwardly on the actuators 1651 and 1652, the retractors 1653 and 1654 are stretched. When the user releases the actuators, the retractors 1653 and 1654 return to their unbiased configurations inside of the shell 1602.

Movement mechanism 1660 includes actuators 1661 and 1662, which extend outwardly from the shell 1602 through holes 1624 and 1630 (see FIG. 48). Actuators 1661 and 1662 are coupled to the panel 1640. Each of the retractors 1663 and 1664 are coupled at one end to the shell 1600 and coupled to the actuators 1661 and 1662 at ends 1665 and 1666, respectively. When the user pulls downwardly on the actuators 1661 and 1662, the retractors 1663 and 1664 are stretched. When the user releases the actuators, the retractors 1663 and 1664 return to their unbiased configurations inside of shell 1602.

Movement mechanism 1670 includes actuators 1671 and 1672, which extend outwardly from the shell 1602 through holes 1636 and 1638, which are located on the front of the garment 1600 (see FIG. 49). Actuators 1671 and 1672 are coupled to the panel 1642. Each of the retractors 1673 and 1674 are coupled at one end to the shell 1600 and coupled to the actuators 1671 and 1672 at ends 1675 and 1676, respectively. When the user pulls downwardly on the actuators 1671 and 1672, the retractors 1673 and 1674 are stretched. When the user releases the actuators, the retractors 1673 and 1674 return to their unbiased configurations inside of the shell 1602.

Movement mechanism 1680 includes actuators 1681 and 1682, which extend outwardly from the shell 1602 through holes 1632 and 1634 (see FIG. 48). Actuators 1681 and 1682 are coupled to the panel 1642. Each of the retractors 1683 and 1684 are coupled at one end to the shell 1600 and coupled to the actuators 1681 and 1682 at ends 1685 and 1686, respectively. When the user pulls downwardly on the actuators 1681 and 1682, the retractors 1683 and 1684 are stretched. When the user releases the actuators, the retractors 1683 and 1684 return to their unbiased configurations inside of the shell 1602.

As illustrated in FIG. 48, the garment 1600 includes guide structures 1690 and 1691 that are disposed in the shoulder regions. Guide structures 1690 and 1691 direct the actuators over the shoulders of the user and provide frictional contact to retain the actuators in a desired position relative to the shell 1602.

Figure 50:
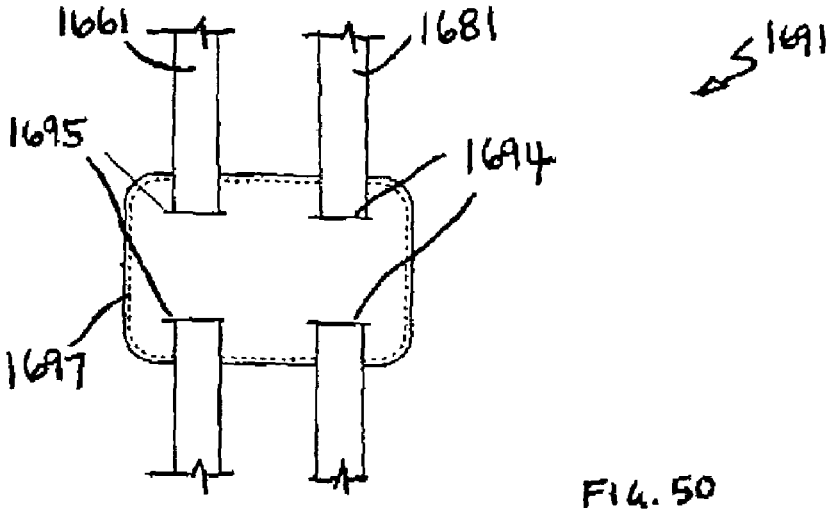
FIG. 50 is a plan view of a guide structure of the garment illustrated in FIG. 46.

An alternative embodiment of a guide structure is illustrated in FIG. 50. In this embodiment, the guide structure 1691 includes two pairs of slots 1694 and 1695 that are configured to receive actuators 1661 and 1681, respectively. The guide structure 1691 also includes an end 1697 that is disposed proximate to the sleeve 1608.

Figure 51:
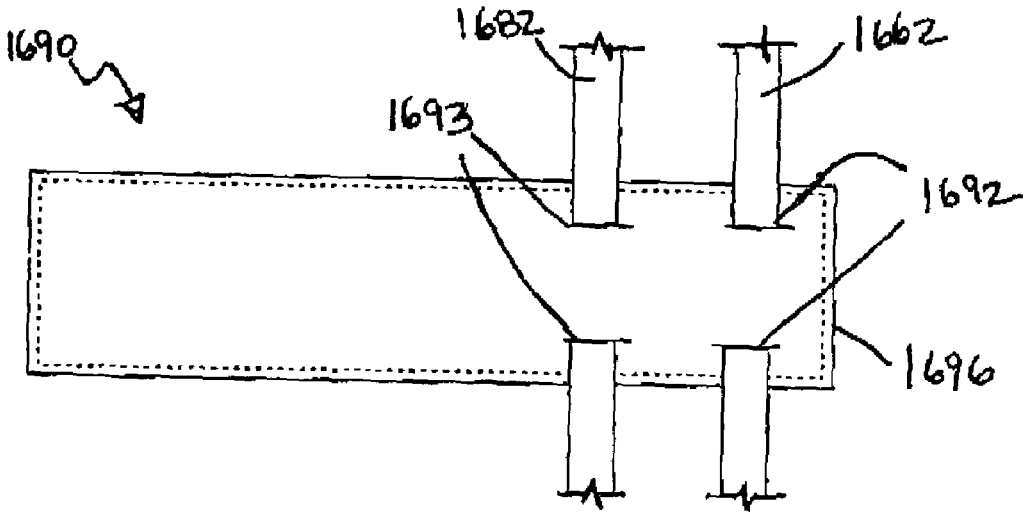
FIG. 51 is a plan view of another guide structure illustrated in FIG. 46.

Similarly, the guide structure 1690 illustrated in FIG. 51 includes two pairs of slots 1692 and 1693 that are configured to receive actuators 1662 and 1682, respectively. The guide structure 1690 also includes an end 1696 that is disposed proximate to the sleeve 1606. The shortened length of guide structure 1691 relative to guide structure 1690 is configured, for example, to accommodate the closure mechanism 1622.

Figure 52:
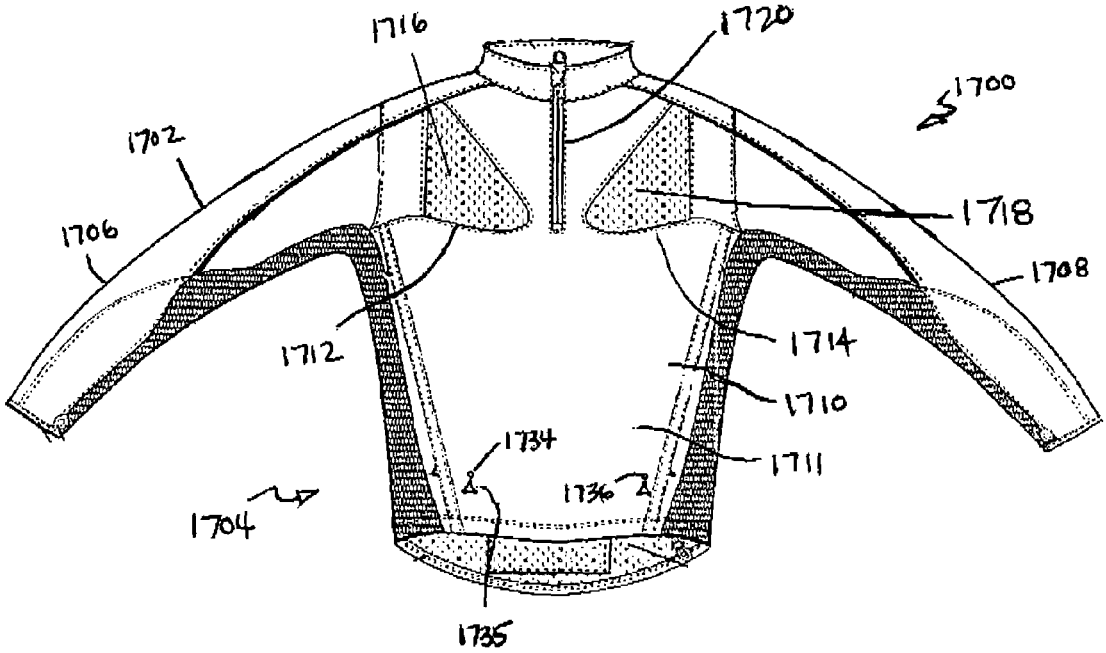
FIG. 52 is a front view of an alternative embodiment of a garment according to the invention.

An alternative embodiment of a garment is illustrated in FIG. 52. In this embodiment, the garment 1700 includes a shell 1702 with a torso region 1704 and sleeves 1706 and 1708. The garment 1700 includes a front panel 1710 that has an outer surface 1711, an inner surface 1712 (see FIG. 53) and holes 1734 and 1736 through which actuators extend. The actuators can have a triangular-shaped pull 1735 coupled to the free ends.

The garment 1700 includes openings 1712 and 1714 disposed on the front of the garment 1700. Openings 1712 and 1714 contain air permeable materials 1716 and 1718, respectively, therein. The garment 1700 includes a closure mechanism 1720 that extends between the openings 1712 and 1714. The split arrangement of the openings 1712 and 1714 in the upper torso region facilitates the use of a front closure mechanism.

Figure 53:
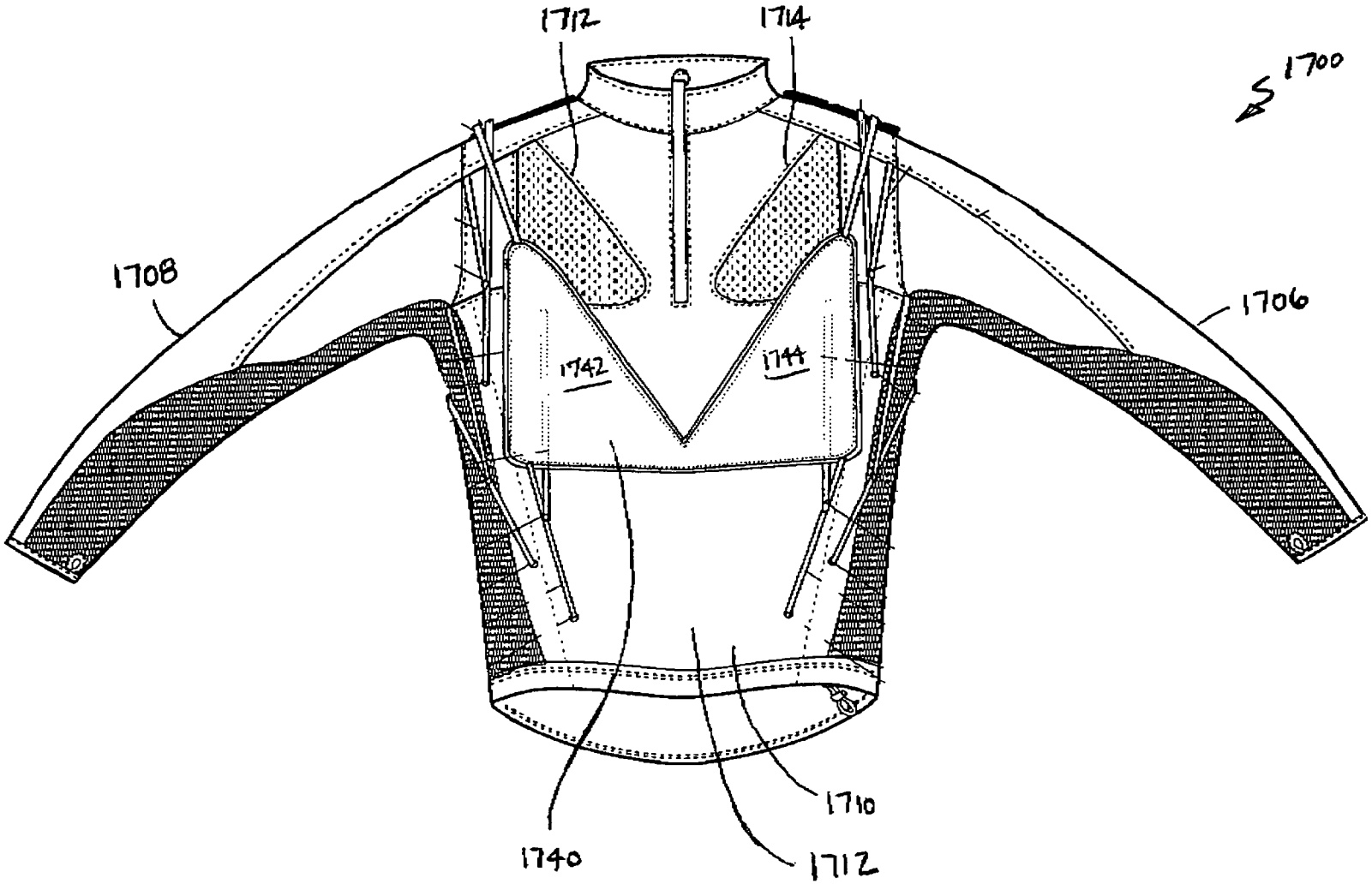
FIG. 53 is a front view of the garment illustrated in FIG. 52 turned inside out with the front inner layer removed.

Referring to FIG. 53, the garment 1700 includes a panel layer 1740 that has two split portions 1742 and 1744. To simplify the discussion of garment 1700, only the front panel is discussed. It is to be understood that the rear portion of garment 1700 may or may not include an opening similar to any of those previously discussed.

FIG. 53 is a front view of the garment 1700 turned inside out. As illustrated, garment 1700 includes movement mechanisms that can be manipulated to move the front movable panel 1740 and a rear movable panel (not shown) upwardly or downwardly relative to their corresponding openings. The movement mechanisms have structures similar to those previously described herein.

Figure 54:
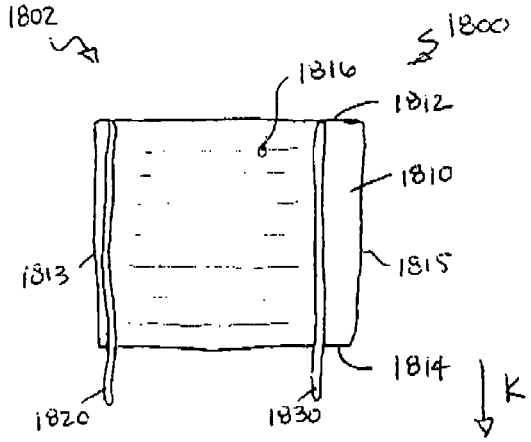
FIG. 54 is a front view of an alternative embodiment of a controlling mechanism according to the invention in a first configuration.
Figure 55:
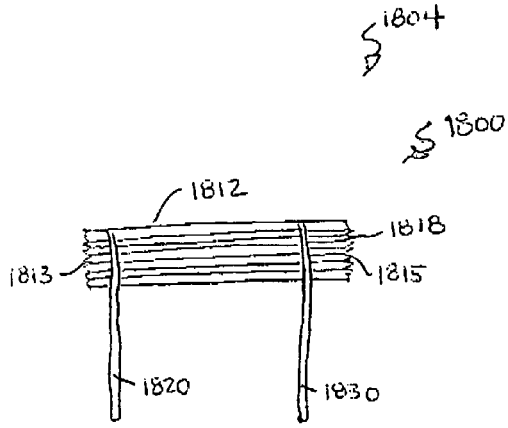
FIG. 55 is a front view of the controlling mechanism illustrated in FIG. 54 in a second configuration.

An alternative embodiment of a controlling mechanism is illustrated in FIGS. 54 and 55. The controlling mechanism 1800 includes a panel 1810 with an upper end 1812, a lower end 1814 and two sides 1813 and 1815. While panel 1810 is illustrated with four sides, in alternative embodiments, panel 1810 can have any shape or construction.

In this embodiment, the panel 1810 includes several creases or folds 1816 that form pleats 1818 and facilitate the collapsing of the body 1810 as illustrated in FIG. 55. The panel 1810 is constructed of a material that is sufficiently flexible so that it can collapse.

The panel 1810 can be disposed proximate to a vent structure in a garment. The panel 1810 is selectively disposable in multiple configurations relative to the vent structure. While in a first or deployed configuration 1802 (see FIG. 54), the panel 1810 is configured so that it is substantially aligned with the vent structure to reduce the air flow therethrough. Two actuators 1820 and 1830 are coupled to the panel 1810 proximate the upper end 1812. When a user pulls on the actuators 1820 and 1830 along the direction of arrow "K," the panel 1810 is collapsed into a second configuration 1804 (see FIG. 55) in which the panel 1810 blocks less of a vent structure in the garment. The pleats 1818 enable the panel 1810 to be collapsed.

A return mechanism (not shown) can be used to move the panel 1810 from its collapsed configuration 1804 to its deployed configuration 1802. One exemplary return mechanism is an actuator. Another exemplary return mechanism is a resilient member, such as a spring, that can be actuated to move the panel 1810 to its deployed configuration 1802. In that embodiment, as the panel 1810 is pulled from configuration 1802 to configuration 1804, the spring is loaded and awaits a subsequent release.

Figure 56:
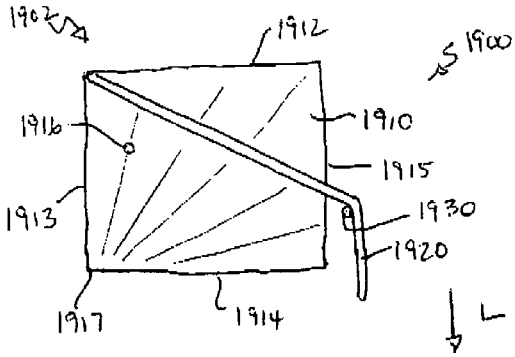
FIG. 56 is a front view of an alternative embodiment of a controlling mechanism according to the invention in a first configuration.
Figure 57:
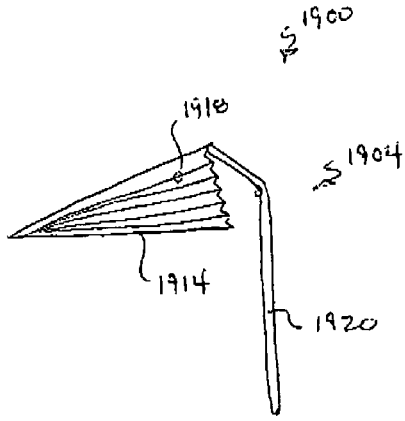
FIG. 57 is a front view of the controlling mechanism illustrated in FIG. 56 in a second configuration.

An alternative embodiment of a controlling mechanism is illustrated in FIGS. 56 and 57. The controlling mechanism 1900 includes a panel 1910 with an upper end 1912, a lower end 1914 and two sides 1913 and 1915. In this embodiment, the panel 1910 includes several creases or folds 1916 that form pleats 1918 and facilitate the collapsing of the body 1910 as illustrated in FIG. 57. The panel 1910 is constructed of a material that is sufficiently flexible so that it can collapse, such as a fabric membrane.

The panel 1910 can be disposed proximate to a vent structure in a garment. The panel 1910 is selectively disposable in a first or deployed configuration 1902 (see FIG. 56) and in a second or collapsed configuration 1904 (see FIG. 57). An actuator 1920 is coupled to the panel 1910 proximate the upper end 1912 and disposed around a guide 1930. As the user pulls on the actuator 1920 along the direction of arrow "L," the panel 1910 moves from its deployed configuration 1902 to its collapsed configuration 1904. A return mechanism (not shown) can be used to move the panel 1910 from configuration 1904 to configuration 1902.

Figure 58:
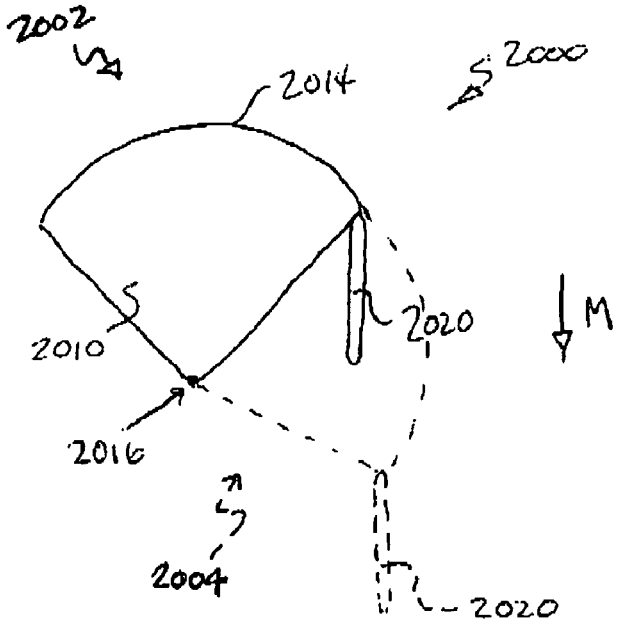
FIG. 58 is a front view of an alternative embodiment of a controlling mechanism according to the invention in multiple configurations.

An alternative embodiment of a controlling mechanism is illustrated in FIG. 58. The controlling mechanism 2000 includes a panel 2010 with a perimeter portion 2014 and a mounting or pivot point 2016. In this embodiment, panel 2010 is mounted for movement about pivot point 2016 and does not collapse. An actuator 2020 is coupled to the panel 2010 to facilitate movement thereof by the user.

In a first or deployed configuration or position 2002, the panel 2010 is disposed so that it reduces the air flow through a vent structure or an opening in a garment. As a user pulls on actuator 2020 along the direction of arrow "M," the panel 2010 rotates from configuration 2002 to a second or non-blocking configuration or position 2004 (shown in phantom). In configuration 2004, the panel 2010 is offset or unaligned from the opening in the garment. A return mechanism (not shown) can be used to move the actuator from configuration 2004 to configuration 2002. A user can move the panel 2010 to any intermediate position or configuration in which a portion of the opening in the garment is blocks, thereby reducing the flow of air into the garment.

Figure 59:
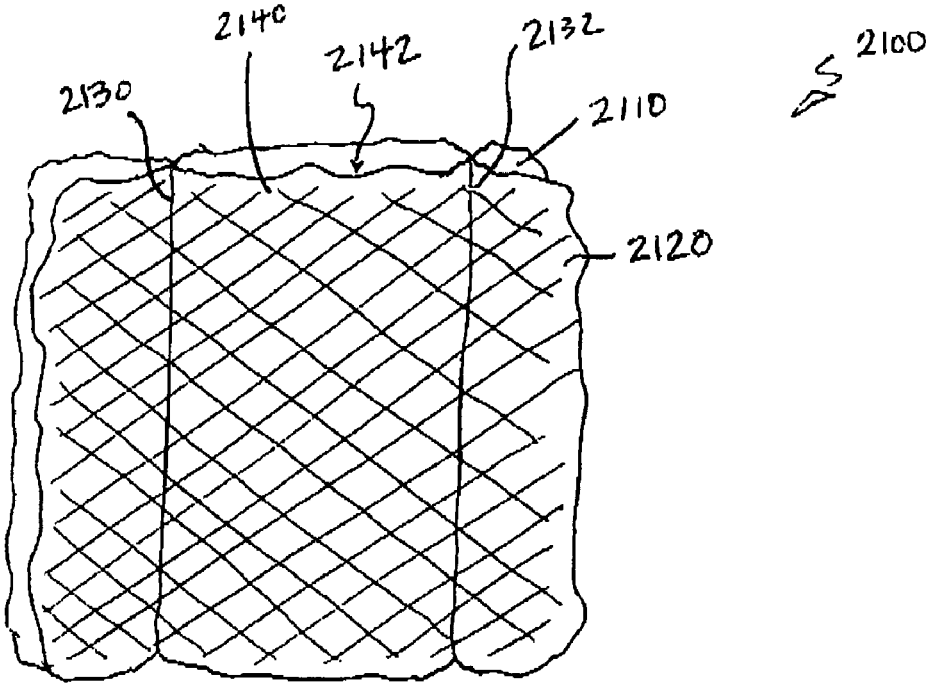
FIG. 59 is a front inside view of some components of an alternative embodiment of a shell according to the invention.

An alternative embodiment of a shell is illustrated in FIG. 59. The shell 2100 includes an outer layer 2110 and an inner layer 2120. Outer layer 2110 includes a vent structure or opening (not shown) similar to those previously described. Inner layer 2120 is an air permeable material, such as mesh. The outer layer 2110 and inner layer 2120 are coupled together by stitching or tacking along seams 2130 and 2132. The seams 2130 and 2132 can be continuous or intermittent.

A guide region 2140 is formed between the seams 2130 and 2132. The guide region 2140 defines a channel 2142 into which a movable panel (not shown) can be inserted and moved. The configuration of the channel 2142 can be varied depending on the desired tightness and friction. The panel slides along the guide region 2140, thereby creating friction. The friction between the panel and the outer and inner layers 2110 and 2120 can be sufficient to retain the panel in place relative to an opening in the outer layer 2110. For example, if a high amount of friction is desired, then the material of the inner layer 2120 in the guide region 2140 is pulled taught and then coupled to the outer layer 2110.

In an alternative embodiment, the garment can include a pocket or pouch disposed on the inner surface of the rear portion of the shell. The pocket can be located in the lower portion with only the zipper accessible from outside the shell.

While the invention has been described in detail and with references to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A garment, comprising:

a shell, the shell including an outer layer and an inner layer, the outer layer having an outer surface, an inner surface and an opening extending from the outer surface to the inner surface, the inner layer having its own outer surface and inner surface, the inner surface of the inner layer defining an interior region, the inner surface of the outer layer and the outer surface of the inner layer defining a chamber therebetween, the opening in the outer layer forming a vent structure in communication with the interior region, the shell including an air permeable material that is disposed in the opening, the air permeable material having a different air permeability than the outer layer;

a movable panel, the movable panel being disposed in the chamber between the outer layer and the inner layer so that the movable panel is located between the vent structure with the air permeable material and the inner layer, the movable panel being selectively disposable in a first position and in a second position relative to the vent structure, the movable panel being substantially aligned with the vent structure in the first position and substantially offset from the vent structure in the second position, the movable panel comprising a layer of material, the movable panel having substantially the same shape when it is in the first position and when it is in the second position; and an actuator, the actuator being coupled to the movable panel so that manipulation of the actuator causes the panel to move from the first position to the second position.

2. The garment of claim 1, wherein the actuator extends through the outer layer to outside the shell.

3. The garment of claim 1, wherein the outer layer includes a hole formed therein, and the actuator extends through the hole and outside the shell.

4. The garment of claim 1, wherein the actuator is a first actuator and the garment further comprises:

a second actuator, the second actuator being coupled to the movable panel, and manipulation of the second actuator causes the movable panel to move from the second position to the first position.

5. The garment of claim 1, wherein the actuator is a first actuator and the garment further comprises:

a second actuator, the second actuator being coupled to the movable panel, manipulation of the second actuator causing the movable panel to move from the second position to the first position, the movable panel including a perimeter, a first end and an opposite second end, the first actuator being coupled proximate to the first end and the second actuator being coupled proximate to the second end.

6. The garment of claim 1, further comprising:

a retractor, the retractor having elastic properties such that the retractor biases the actuator inwardly with respect to the shell, the retractor including a first end and a second end, the first end of the retractor being coupled to the actuator and the second end of the retractor being coupled to the shell.

7. The garment of claim 1, wherein the vent structure is a first vent structure, the shell includes a front portion, a rear portion and a second vent structure, the rear portion includes the first vent structure and the front portion includes the second vent structure.

8. The garment of claim 1, wherein the vent structure is a first vent structure and the movable panel is a first movable panel, the shell includes a front portion, a rear portion and a second vent structure, the rear portion includes the first vent structure and the front portion includes the second vent structure, the first movable panel is disposable proximate to the first vent structure, the garment further comprising:

a second movable panel, the second movable panel being disposable proximate to the second vent structure;

a third actuator coupled to the second movable panel, the third actuator being manipulatable to move the second movable panel from its own first position in which it is substantially aligned with the second vent structure to its own second position in which it is substantially offset from the second vent structure; and a fourth actuator coupled to the second movable panel, the fourth actuator being manipulatable to move the second movable panel from its second position to its first position.

9. The garment of claim 1, wherein the shell includes a shoulder region, and a portion of the actuator passes through the shoulder region.

10. The garment of claim 1, wherein the shell includes a shoulder region, a portion of the actuator passes through the shoulder region, and a guide structure is coupled to the shell and disposed proximate to the shoulder region, the actuator slidably engaging the guide structure.

11. The garment of claim 1, wherein the movable panel has the same configuration in the first position as the movable panel does when it is in the second position.

12. A garment, comprising:

a shell, the shell including an outer layer and an inner layer, the outer layer having an outer surface, an inner surface and an air flow opening, the air flow opening having a mesh structure disposed within and coextensive with the air flow opening, the inner layer having an outer surface and an inner surface, the inner surface of the outer layer and the outer surface of the inner layer defining a space therebetween;

a movable panel, the movable panel being selectively positionable in a first position in which the movable panel blocks air from entering and exiting through the air flow opening and in a second position in which the movable panel permits air to enter and exit through the air flow opening, the movable panel comprising a layer of material, the movable panel having the same shape when it is in the first position and when it is in the second position;

a first actuator portion coupled to the movable panel, the first actuator portion being manipulatable to move the movable panel between the first position and the second position along a first direction relative to the air flow opening; and a second actuator portion coupled to the movable panel, the second actuator portion being manipulatable to move the movable panel between the second position and the first position along a second direction relative to the air flow opening, the second direction being different from the first direction.

13. The garment of claim 12, wherein the mesh structure in the air flow opening is exposed to outside the shell when the movable panel is in its first position and when the movable panel is in its second position.

14. The garment of claim 12, wherein the shell includes a shoulder region, and part of the second actuator portion extends through the shoulder region.

15. The garment of claim 14, wherein the movable panel is a first movable panel and the air flow opening is a first air flow opening, the shell includes a front portion and a rear portion, the rear portion includes the first air flow opening, the front portion includes a second air flow opening, and the garment further comprises:

a second movable panel, the second movable panel being selectively positionable in its own first position in which the second movable panel blocks air from entering and exiting the interior region through the second air flow opening and in its own second position in which the second movable panel permits air to enter and exit the interior region through the second air flow opening;

a third actuator portion coupled to the second movable panel, the third actuator portion being manipulatable to move the second movable panel in its own first direction relative to the second air flow opening; and a fourth actuator portion coupled to the second movable panel, the fourth actuator portion being manipulatable to move the second movable panel in its own second direction relative to the second air flow opening, the first direction of the first movable panel being opposite the first direction of the second movable panel, and the second direction of the first movable panel being opposite the second direction of the second movable panel.

16. The garment of claim 12, wherein the shell includes a shoulder region and a lower end opposite the shoulder region, the movable panel moves toward the shoulder region while moving along the first direction, and the movable panel moves toward the lower end while moving along the second direction.

17. A garment, comprising:

a shell having an inner layer, an outer layer, a front side and a rear side opposite the front side, the inner layer including an outer surface and an inner surface, the inner surface defining an interior region, the outer layer including an outer surface, an inner surface, and opening extending through the outer layer, the opening being configured to form a vent structure in the outer layer;

a panel having a first end and a second end opposite the first end, the panel being movably disposed between the outer surface of the inner layer and the inner surface of the outer layer, the panel being movable between a first position in which the panel blocks the opening and a second position in which the panel is spaced apart from the opening, the panel comprising a layer of material, the panel having substantially the same shape when it is in the first position and when it is in the second position;

a first actuator having a first end and a second end, the first end of the first actuator being coupled to the first end of the panel, the second end of the first actuator extending out from the front side of the shell, the first actuator configured to move the panel in a first direction; and a second actuator having a first end and a second end, the first end of the second actuator being coupled to the second end of the panel, the second end of the second actuator extending out from the rear side of the shell, the second actuator configured to move the panel in a second direction opposite the first direction.

18. The garment of claim 17, wherein the shell includes a shoulder region, and a portion of the first actuator is disposed through the shoulder region of the shell between the inner layer of the shell and the outer layer of the shell.

19. The garment of claim 17, wherein the panel includes a first portion with a perimeter, a second portion with a perimeter, and a binding that is sewn around the perimeter of the first panel portion and the second panel portion to couple the first panel portion to the second panel portion.

20. The garment of claim 17, wherein the panel has a first corner and a second corner defining the first end therebetween and a third corner and a fourth corner defining the second end therebetween, the first actuator is coupled to the panel proximate to the first corner, the second actuator is coupled to the panel proximate to the third corner, and the garment further comprises:

a third actuator, the third actuator being coupled proximate to the second corner, the third actuator being configured to move the panel along the first direction; and a fourth actuator, the fourth actuator being coupled proximate to the fourth corner, the fourth actuator being configured to move the panel along the second direction.

21. The garment of claim 17, wherein a mesh material is disposed in the opening of the vent structure.

22. The garment of claim 21, wherein the mesh material is exposed to outside of the shell when the panel is in the first position and when the panel is in the second position.

23. The garment of claim 22, wherein the panel has the same configuration when the panel is in the first position and when the panel is in the second position.

* * * * *